United States Patent [19]

Coyle et al.

[11] 3,995,541

[45] Dec. 7, 1976

[54] RAILWAY HOPPER CAR HAVING BAFFLES DECREASING LOAD DENSITY

[75] Inventors: Edward L. Coyle, Fairborn, Ohio; Edgar F. Josephson, St. Charles, Mo.

[73] Assignee: ACF Industries, Incorporated, New York, N.Y.

[22] Filed: Oct. 31, 1973

[21] Appl. No.: 411,379

[52] U.S. Cl. ..... 98/6; 105/239; 105/248; 105/355; 105/360; 105/375; 220/1.5; 222/547; 222/564; 296/3; 298/28; 312/351

[51] Int. Cl.[2] ..... B61D 3/16; B61D 5/04; B61D 7/02; B61D 21/00

[58] Field of Search ..... 34/22, 46; 62/133, 134, 62/242, 464; 98/6, 14; 105/239, 247, 248, 375, 360, 355; 198/57; 214/16 R, 83.28; 220/1.5, 22; 222/464, 547, 564; 296/3, 4, 5, 15, 24 B, 33; 298/24, 27, 28; 302/52; 312/351; 193/32

[56] References Cited

UNITED STATES PATENTS

| | | | |
|---|---|---|---|
| 120,109 | 10/1871 | Sampson | 98/6 |
| 676,104 | 6/1901 | Souder | 105/248 |
| 782,927 | 2/1905 | Saling | 105/248 |
| 866,674 | 9/1907 | Olden | 105/247 |
| 1,081,032 | 12/1913 | Evans | 105/360 |
| 1,600,310 | 9/1926 | Burbidge | 105/248 |
| 1,745,716 | 2/1930 | Rynders | 222/459 |
| 2,513,450 | 7/1950 | Carlisle, Sr. | 222/547 X |
| 2,675,274 | 4/1954 | Engelhart | 214/83.28 X |
| 3,192,877 | 7/1965 | Wright | 105/360 |
| 3,257,145 | 6/1966 | Case et al. | 298/24 X |
| 3,277,842 | 10/1966 | Schwartz, Jr. et al. | 105/358 |
| 3,341,090 | 9/1967 | Reimbert | 222/464 |
| 3,486,241 | 12/1969 | Coyle et al. | 98/6 X |
| 3,572,252 | 3/1971 | Coover et al. | 105/248 |
| 3,694,925 | 10/1972 | Coyle et al. | 98/6 X |
| 3,707,222 | 12/1972 | Hartley | 198/57 |
| 3,707,249 | 12/1972 | Tomlinson | 222/464 |
| 3,738,507 | 6/1973 | Livingston | 193/32 X |
| 3,899,981 | 8/1975 | Josephson | 105/355 |

FOREIGN PATENTS OR APPLICATIONS

| | | | |
|---|---|---|---|
| 437,516 | 11/1926 | Germany | 105/239 |
| 179,514 | 5/1962 | Sweden | 222/459 |

*Primary Examiner*—Robert J. Spar
*Assistant Examiner*—Howard Beltran
*Attorney, Agent, or Firm*—Henry W. Cummings

[57] ABSTRACT

Baffles are provided in transportation hoppers to solve the problem of upper bulk lading exerting pressure and causing damage to lower bulk lading in the hopper by reducing load density of the lading. The baffles are preferably inclined with respect to the horizontal. More than one layer of baffles may be provided. Supports for the baffles are preferably fixed to the sides and/or roof of the transportation hopper. The baffles may be provided with openings to facilitate circulation of conditioned air through the hopper. The baffles may be provided with larger openings which facilitate loading the hopper. The baffles also may be provided with doors which facilitate loading the hopper by means of a loading chute. The baffles may be used in a wide variety of transportation hoppers. In a preferred embodiment the transportation hopper is a railway hopper car.

54 Claims, 32 Drawing Figures

RAILWAY HOPPER CAR HAVING BAFFLES DECREASING LOAD DENSITY

BACKGROUND OF THE INVENTION

In U.S. Pat. Nos. 3,486,241 and 3,694,925, assigned to the same assignee as the present application, railway cars are disclosed in which circulating air passes throughout the lading, through an air conditioning unit and back to the lading. Through the use of these air conditioned cars, it is possible to transport perisable or damagable ladings in bulk. Considerably less damage to the lading in hopper cars is observed than with a hopper car not utilizing condition air.

However, one problem which the use of conditioned air does not solve is the problem of the pressure that the weight of the lading in the upper portion of the car exerts on the lading in the lower portion. While the general shape of some railway cars, such as hopper cars, functions to distribute the lading weight somewhat, the hopper shape is not sufficient to avoid damage to the lading caused by the upper lading weight acting upon the lower leading, particularly if the hopper car is full.

The problem of damage to lading caused by the weight of the upper lading on the lower lading is, of course, not limited to air conditioned cars, but is rather a problem common to nearly all bulk lading transfer where the lading is of a perishable or damagable type and an upper bulk portion exerts a force or weight on a lower bulk portion.

SUMMARY OF THE INVENTION

It therefore is an object of the present invention to provide baffle structure in transportation hopper, particularly railway cars to reduce or avoid damage done to a perishable or damagable bulk lading by the weight of the upper portion of said lading acting upon the lower portion thereof.

It is another object of the present invention to provide in some embodiments means in the supporting structure for allowing circulation of conditioned air through the lading.

In accordance with the present invention, the problem of upper leading weight exerting pressure and causing damage to lower bulk lading in transportation hoppers, particularly railroad cars is solved through the use of appropriately mounted baffles means within the car. In embodiments in which it is desirable to allow conditioned air to circulate through the lading the baffles are made of permeable material or openings may be provided in the baffles, between the baffles, and between the baffles and the car structure to allow such circulation. In accordance with one embodiment of the present invention, openings or slots are provided in the baffles of a size sufficiently small to avoid lading sitting on the openings and blocking air flow. In another embodiment the baffle system is designed so as to minimize or avoid extensive dropping of the lading during loading and unloading. In another embodiment it is preferred to utilize a large amount of the available volume of the hopper. To this end the baffle angle is preferably not less than the approximate angle of repose of the lading commodity. In accordance with another embodiment of the invention the baffles are preferably spaced from the sides of the hoppers to facilitate obtaining fill in the space under the baffles. The space must not be too great to that excess pressure is exerted in the lading below. In another embodiment openings of a size sufficient for the lading to pass through are provided in selected baffles to obtain more efficient fill and greater utilization of hopper volume. In another embodiment two, three or more levels of baffles may be provided. In still another embodiment the baffles may be removable.

In accordance with another embodiment the baffles are spaced from the hopper sides and extend inwardly from opposite sides of the hopper, but are spaced from one another to define an opening in the center portion of the hopper. In another embodiment the baffles from one side of the hopper extend to a point lower than the corresponding baffles from the opposite side of the hopper. In another embodiment doors are provided at the inner ends of selected baffles to facilitate the use of a loading chute in loading the hoppers.

Supports for the baffles are preferably affixed to one or more sides of the hopper. It is also preferred that the baffle supports be affixed to opposite sides of the hopper and extend inwardly to support the baffles. In accordance with one embodiment of the invention, support for some for all of the baffles is provided by flexible members such as chains or ropes. In accordance with another embodiment, rigid support arms extend inwardly from the hopper sides to support the baffles. In accordance with another embodiment of the invention, the baffles are affixed to opposite sides of the support arms and extend laterally from opposite sides of the support arms. In accordance with another embodiment of the invention, the support arms from opposite sides of the hopper may be joined, to provide improved strength and rigidity to the hoppers. In accordance with another embodiment of the invention, hopper reinforcement structure may be provided. In accordance with one embodiment transversely extending members are affixed to the upper portion of the opposite sides of the hopper. In accordance with another embodiment support members are provided longitudinally in the car joining and lower portions of the hoppers.

The baffles and support structure may be used in railway hopper cars, in hopper type overland trucks, in hoppers contained in ships, and in hopper type containers which may be carried on railroad cars, overland trucks, or in ships, and in hopper type containers adapted for general use in intermodal transport.

DETAILED DESCRIPTION - GENERAL CONSIDERATIONS

Figure 2:
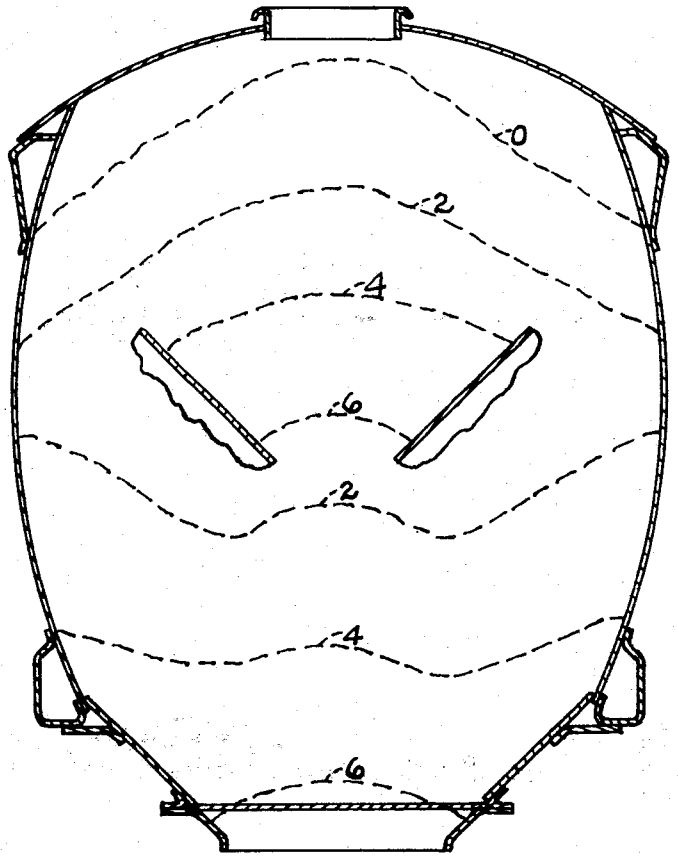
FIG. 2 is a view similar to FIG. 1 showing a reduction in the lines of equivalent lading pressure when a single level baffle system is utilized.
Figure 1:
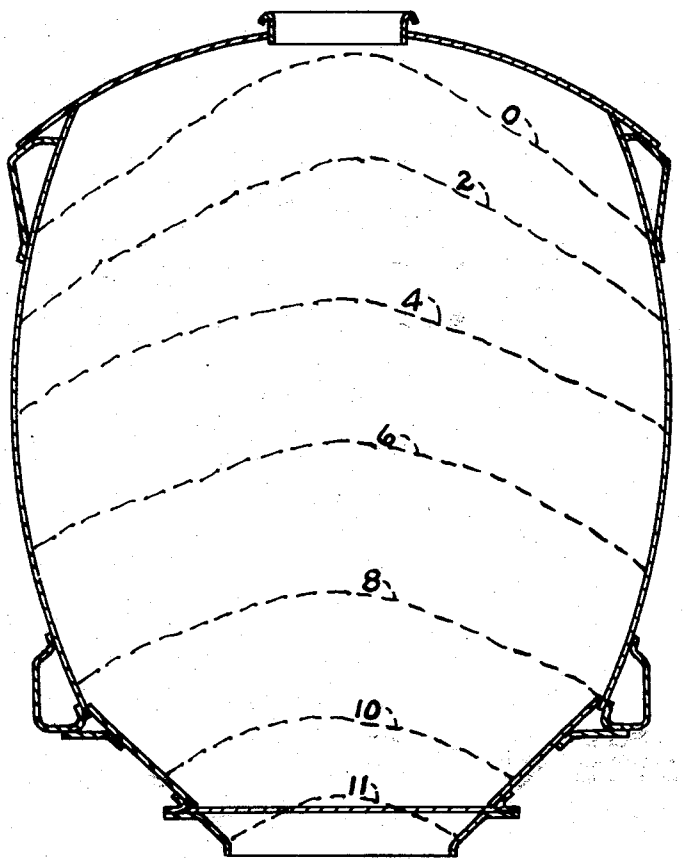
FIG. 1 is a schematic sectional view of a hopper illustrating the contour of the lines of equal lading pressure for various heights of equivalent lading pressure.

FIG. 1 schematically shows the lines of equal pressure due to bulk lading weight in a hopper railroad car. A simple one level baffle system is illustrated schematically in FIG. 2. A comparison of FIGS. 1 and 2 illustrated that instead of the entire lower portion of the lading bearing an equivalent lading pressure of from 6 to 11 feet, with the baffles of FIG. 2 the maximum height generating lading pressure is 6 feet. These numbers are not to be considered as limiting but merely illustrative of the reduction in lading pressure which can be obtained with an appropriately designed baffle system for transporting hoppers.

In accordance with one embodiment of the present invention, it is desired to reduce the effective pressure to the equivalent of not more than approximately 3 feet of free height. This is particularly advantageous in the transport of citrus ladings.

Another important consideration in the baffle design of the present invention is that for some ladings under certain conditions it is desired that air flow from a conditioning unit pass through the lading and then back to the conditioning unit. The circulating air is preferably generally uniformly distributed in the car. For these applications it has been found that the baffles must be provided with means to render the baffle permeable. In accordance with one embodiment. This can be obtained by utilizing an inherently permeable baffle material. In accordance with another embodiment of the invention slots or openings are provided to obtain permeability; perferably the smallest dimension, such as the diameter of a hole or the width of a slot, not be greater than about ½ inch. If the smallest dimension is much greater than ½ inch, the lading tends to sit in the openings. This may cause dents in the produce from the edges of the openings, and/or block air flow and/or make discharge of the lading difficult.

Another consideration which must be taken into account is that the lading is generally loaded from the top and unloaded from the bottom. Lading flows by gravity during the loading operation. It is desirable to minimize or at least keep within reasonable limits, the extent of spilling and dropping of the lading, in loading and unloading.

A wide variety of ladings off a perishable or nonperisable nature may be transported. For best results the lading is generally round and not unduly oblong. Examples include citrus fruits, potatoes, onions, pears, lettuce preferably wrapped, and peaches.

Another important objective of the baffle design is to utilize as much as possible of the available volume of the hopper. In this regard the angle of repose of the commodity with respect to the horizontal can provide guidelines as to what the baffle angle should be with respect to the horizontal. The baffle angle is preferably not less than approximately the angle of repose of the lading. Examples of angles of repose of various perishable lading include potatoes, approximately 37.5° and oranges about 32°. It will be apparent that a balance must be struck between a baffle design which accommodates the angle or repose of the lading and thus makes most effective utilization of hopper volume and at the same time provides protection against the weight of the upper lading causing damage to the lower lading. Baffles which are absolutely vertical would be the optimum from the standpoint of angle of repose of the lading and volume utilization whereas a completely horizontal baffle system would be preferred in terms of reducing the upper lading pressure acting upon the lower lading. Furthermore, a hopper to be designed for a particular lading service to maximize cube fill, the baffle angle should be quite near the angle of repose of the commodity. However, for an all purpose hopper service will various perishable ladings, it has been found that baffles having an angle with respect to the horizontal of about 30° to 50° functions satisfactory. Preferably this angle should be 32° to 40° for maximum volume utilization for most perishable ladings.

In accordance with another embodiment there is a space between the hopper wall and the baffles. It is necessary to have a space between the baffles and the wall in order to obtain a fill in the space under the baffles. At the same time, if the space is too great to pressure from the lading above the baffle will be exerted upon the material below the baffle and the pressure reduction objective of the present invention will not be obtained. In accordance with another feature of the present invention, it has been found that the space between the hopper side and the baffle is preferably from about eight (8) to twelve (12) inches for most perishable ladings. Most preferably, the distance is from about nine (9) to about eleven (11) inches.

Further, with regard to the problem of efficiently filling the hopper with a minimum of droppage and damage to the lading, it has been found that if in selected baffles openings are provided for the lading to pass through during loading, damage to the lading is minimized and where the baffle angle is less than the angle of repose of the lading the fill is more efficient and greater utilization of the hopper volume is obtained. Thus the size of openings is preferably such as to allow product to roll through in loading but will bridge over and not transmit full load on the product below the hole during transit. The openings are preferably about eight (8) to about twelve (12) inches for most periodable, ladings.

One, two, three or more levels of baffles may be provided depending on the shape and capacity of the particular hopper and the lading to be transported. If desired, the baffles may be removable to transport non-perishable lading.

DESCRIPTION OF PREFERRED EMBODIMENTS

Figure 3:
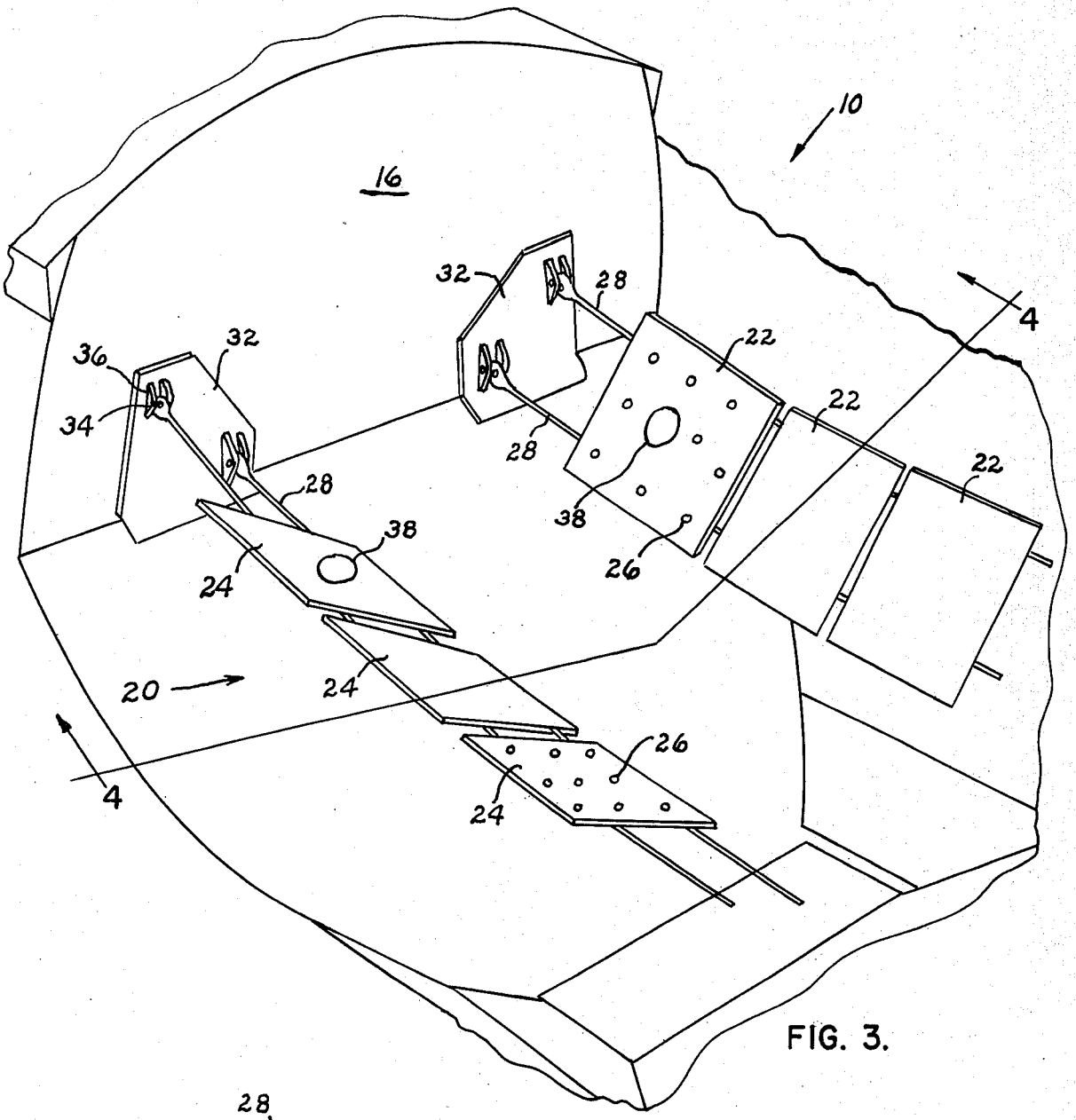
FIG. 3 is a partial perspective view illustrating one embodiment of a single level baffle design.
Figure 4:
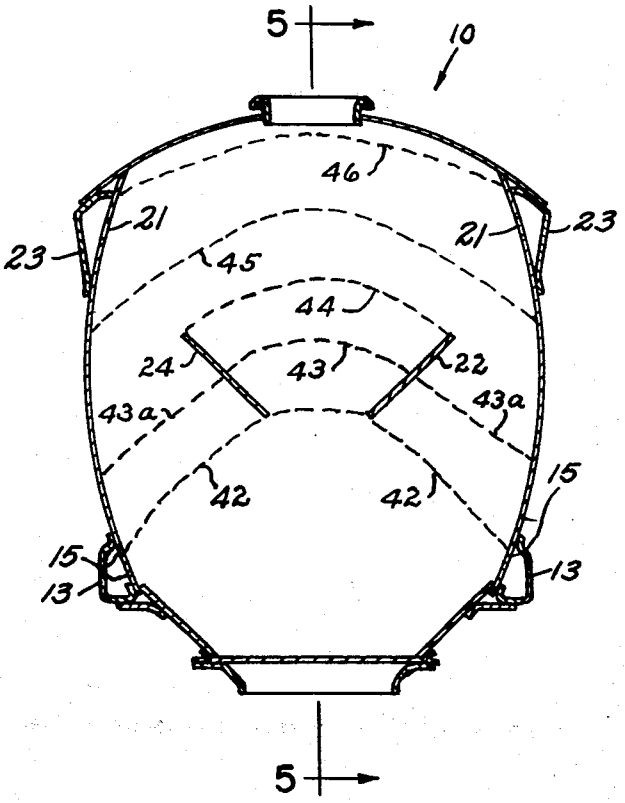
FIG. 4 is a sectional view along the line 4—4 in FIG. 3 further illustrating the design shown in FIG. 3.
Figure 5:
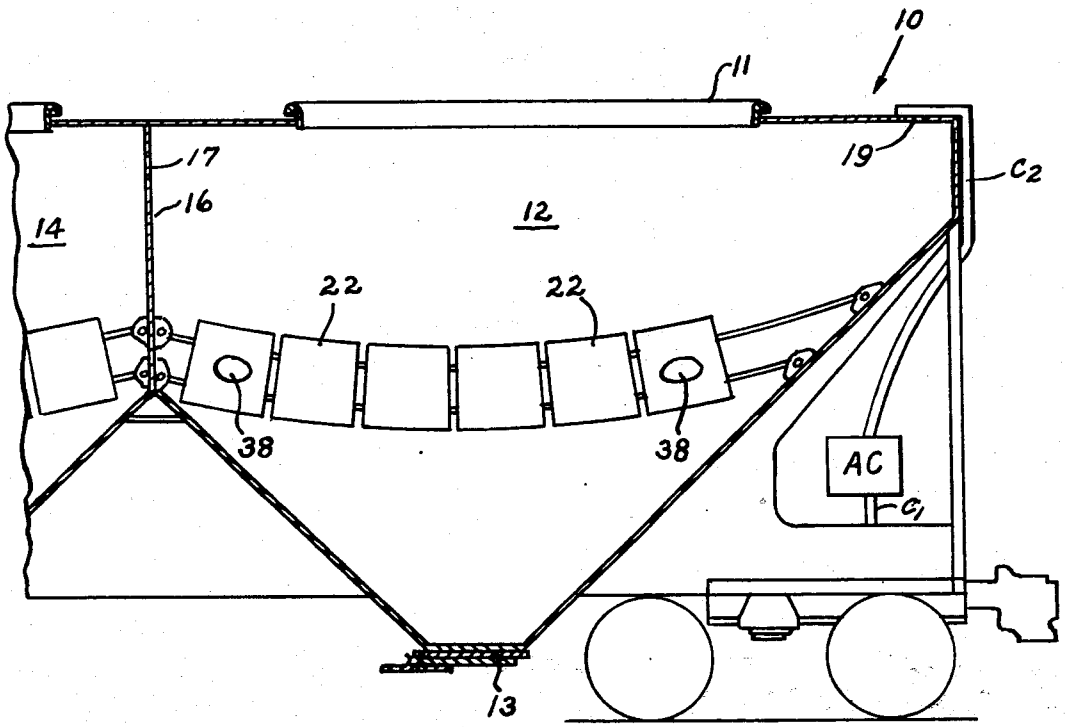
FIG. 5 is a sectional view along the line 5—5 in FIG. 4.

The baffle configuration may take many forms. One embodiment of a single level system is illustrated in FIGS. 3 through 5.

In this embodiment a transportation vehicle 10 is shown comprising a plurality of hoppers 12, 14 and having bulkheads therebetween 16. Transportation vehicle 10 may be, for example, a railroad car, overland truck, or a container. Baffle means indicated generally at 20 are provided comprising a plurality of spaced inclined baffle members 22 and 24 mounted longitudinally in the car, spaced from the car sides and having openings therebetween. Baffles 22 and 24 are preferably substantially identical and may be made of metal, metal alloy, wood, strong plastic or other appropriate construction material.

Figure 3A:
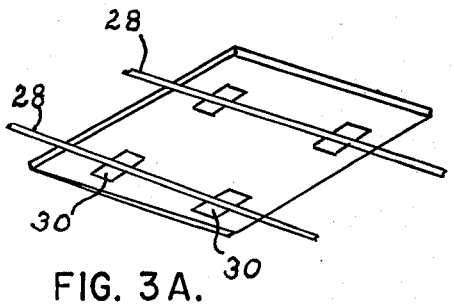
FIG. 3A is a detailed view illustrating one way of affixing the supporting ropes or cables to the baffles.

Baffles 22 and 24 may be held in place by rope or cables 28 affixed to the baffles by appropriate means such as brackets 30 as shown in FIG. 3A. Cables 28 are also affixed to bulkheads 16 by appropriate means. For example, the ropes or cables may be affixed to plates 32 by means of pins 34 held in place by brackets 36. Plates 32 may then be appropriately affixed to bulkheads 16, for example, by bolting or welding.

If desired an air conditioning unit to heat, cool and/or control the humidity of air to be circulated through the hoppers may be provided, as described in detail in U.S. Pat. No. 3,486,241, for example, at the end of the transportation vehicle 10 labeled A.C. in FIG. 5. For example, the conditioned air may be circulated through appropriate conduits $C_1$ into the the side sills 13, (FIG. 4) and through openings 15 into the hoppers. In the hoppers the conditioned air passes upwardly and then longitudinally toward the end of the transportation vehicle, passing from hopper 14 through opening 17 in transverse bulkhead 16. An opening 19 may be provided in the roof which communicates with conduit $C_2$ to return the air to the air conditioning unit A.C. Alternatively, the air may be returned through openings 21 (indicated in FIG. 4 only) and hollow side plates 23, as described in detail in the U.S. Pat. No. 3,456,241 patent. Furthermore, the cycle may be reversed.

If desired for conditioned air to pass through, small openings 26 may be provided in the baffles, although for some applications involving perishable ladings this may not be necessary since there is considerable space between and beside the baffles for air circulation. If openings are provided it is preferred that the smallest not exceed about one-half inch to avoid damage to the lading blocking the passage of air through the openings. Large openings 38 may be provided in selected baffles preferably having dimensions of from 8 inches to 12 inches for lading to pass through to facilitate lading filling the space below the baffles during loading, and allow for lading to bridge over openings and not transmit load through openings during transit. The baffles are also preferably spaced 8 to 12 inches from the hopper side to facilitate lading fill below the baffles.

In the loading sequence for the embodiment shown in FIGS. 3–5, a loading chute would first be extended down into loading opening 11 between baffles 22 and 24 and the lading loaded up to approximately the line 42 shown in FIG. 4. Then the loading chute is raised above the baffles and the lading assumes the pattern indicated at 43 in FIG. 4. If baffle openings 38 are provided in at least one end of the baffles and either a loading chute or the cara is moved to obtain registry with these openings, the car will then pass through the openings and roll down the end portion of the hopper and begin to fill up the void section to obtain a configuration similar to line 43a. With contained filling the pile will assume a contour indicated at 44. After this point, the lading will begin to drop over the side of baffles 22 and 24 and fill up the sides as indicated at line 45. Then the chute is simple gradually moved up and the final lading assumes a contour similar to line 46.

Whether or not the lower portion of a particular lading can withstand the pressure of the entire upper lading weight will depend upon the particular lading. For citrus fruit, for example, it is preferred not to fill the car all the way up to the top in the case of a single baffle design.

It will be apparent that through the use of openings 38 the extent of the drop in loading the car is substantially reduced.

The hopper is unloaded by gravity through outlet 13. For example, a longitudinally extending conveyor may be appropriately positioned below or connected to outlet 13. The lading below baffles 22 and 24 unloads first. As unloading occurs lading from above fills the space below baffles 22 and 24 by passing between baffles 22 and 24 and by passing between the baffles and the side and ends of the hopper. Some lading passes through openings 38 during unloading but the volume is not great, probably less than 5%.

It will also be apparent that the baffles are readily removed by removing the cables and baffles and they can be stored elsewhere. For examples, they could be stored by affixing them to the roof of the car or they may be stored at a given loading and/or unloading facility until such time as they would be used again.

FIGS. 6 through 9 illustrate another embodiment of the present invention wherein a two level baffle design is shown. In this embodiment a hopper 100 has side sheets 102 and 104 welded to side plates 110 and 112. Side sills 106 and 108 which, if desired, may be utilized for circulating conditioned air in accordance with the description in U.S. Pat. No. 3,486,241 which is hereby incorporated into the present application by reference. For example, an air conditioning unit labeled A.C. in FIG. 7 may be installed on one end of the car to heat, cool and/or control the humidity of air and cause the conditioned air to circulate from the unit A.C. through conduits $C_3$ the side sills 106, 108 (FIG. 6) into the hoppers through openings 107, and downwardly toward the outlet 122 below guide plates 128 and 130.

Figure 8:
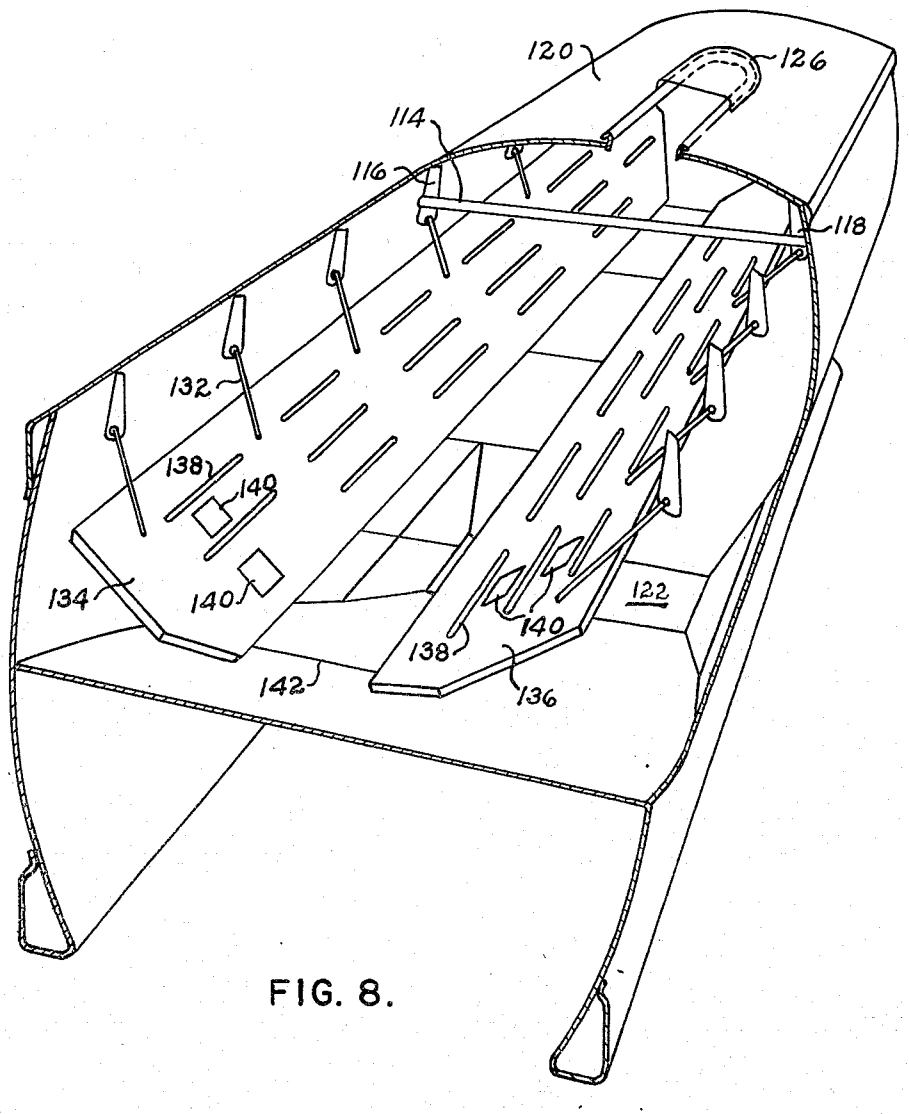
FIG. 8 is a partial perspective view illustrating the upper baffles of the embodiment shown in FIG. 6.

The air then circulates upwardly upwardly two layers of baffles, through the between the baffles and also through openings 138 and 140 shown in FIG. 8. The air then passes longitudinally toward the end of the car, through openings 109 in transverse bulkheads 111. The air then passes through openings 113 in the roof into conduit $C_4$ and is circulated back into the air conditioning unit A.C.

A transversely extending upper reinforcing member 114 is provided which is affixed to the cars sides by means of bracket supports 116 and 118. The car also has a roof 120 and hatches 126 of known construction. An outlet of known construction 122 is also provided.

The upper baffle system indicated generally at 130 is affixed with appropriate means, for example, with wire or ropes 132 to bracket supports 116 and 118. The upper baffle members 134 and 136 are shown in an enlarged view in FIG. 8. Upper baffle members 134 and 136 may be made of permable material, or may be made of appropriate construction material, such as wood or metal, and have openings therein 138. For example, the openings 138 may take the form of elongated slots having the smaller dimension, preferably not greater than about one-half inch to avoid lading sitting on the openings and becoming damaged by the edges and/or blocking air flow.

In addition, selected ones of the baffles 134 and 136, larger openings 140 may be provided to facilitate loading the car. Both of the dimensions for the openings 140 are preferably within the range of 8 inches to 12 inches which has been found to be the most effective range for efficient loading without transmitting load pressure in transit. If desired, upper baffle members 134 and 136 may be connected along the longitudinal length of the car by means of transverse members 142 which may be affixed to the baffles by appropriate fasteners.

Figure 6:
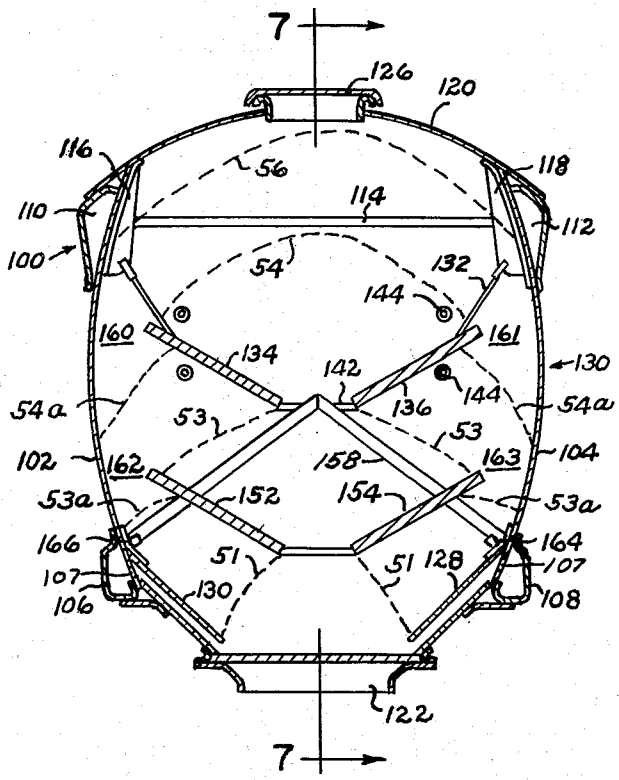
FIG. 6 is a transverse sectional view through a hopper illustrating one embodiment of a two level baffle design.
Figure 7:
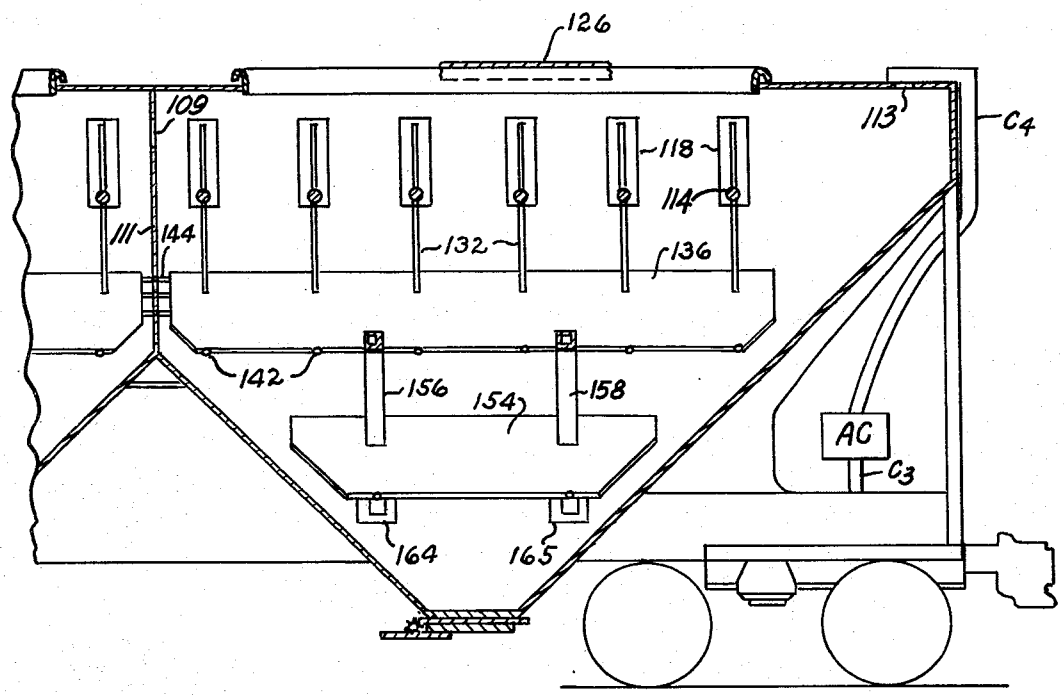
FIG. 7 is a view along the line 7—7 in FIG. 6.

As indicated in FIGS. 6 and 7, a plurality of longitudinally extending cables or rods 144 are preferably provided which transmit the longitudinal impact loads from the baffles 134 and 136 to the car structure as shown in FIG. 6, as described hereinafter.

Figure 9:
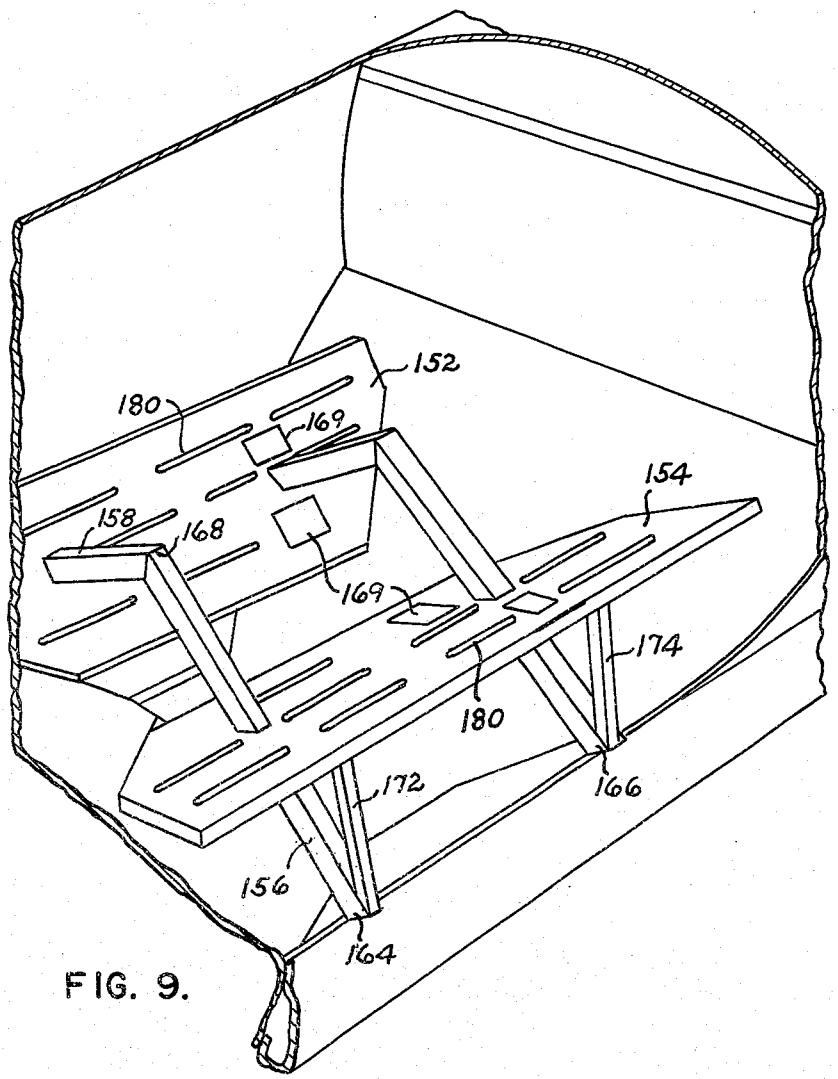
FIG. 9 is a partial perspective view illustrating the lower level baffles of the embodiment shown in FIG. 6.

The lower baffle system is indicated generally at 150 and comprises baffle members 152, 154 mounted at an incline with appropriate support means. For example, as illustrated in FIG. 9, the support means comprises beams 156 and 158, affixed to the sides oif the hopper by appropriate means such as welding or bolts as indicated at 164 and 166. The beams are joined together generally at the central portion of the car as indicated at 168 with appropriate means, such as welding or bolts. Alternatively, beams 156 and 158 may comprise a single generally triangular shaped member. Additional supports 172 and 174 are also provided to engage respectively baffles 152 and 154. Supports 156, 158, and 172 and 174 are affixed to baffles 152 and 154 in appropriate fashion so as to obtain the desired incline. As mentioned previously, it is preferred that the incline not substantially exceed the angle of repose of the lading. Air flow slots 180 may also be provided, as discussed above, to facilitate circulation of conditioned air.

As has also been discussed before, the baffles are spaced from the side of the car is indicated at 160, 161, 162 and 163, preferably within 8 inches to 12 inches to facilitate effective loading and fill. In loading the embodiment shown in FIGS. 6–9, a loading chute is first lowered through hatch opening 126 down between baffles 152 and 154. The initial level of lading then is filled up along the line 51. Then the chute is raised further and the lading assumes the line 53 above the baffles 152 and 154. It will be noted from FIG. 9 that lading openings 169 are preferably provided in at least the end of the baffles, near the slope sheets or in the vicinity of the loading chute. Thus the lading will enter these openings, roll down the slope sheet, and fill up the lower portion on top of line 51 up to the extent of line 53*a*, as shown in FIG. 6. Then the loading chute is raised above baffle members 134, 136, and the lading then assumes a configuration along the line 54. As shown in FIG. 8 lading openings 140 are preferably provided at least a portions adjacent where the loading chute is likely to be inserted for loading so that the lading fills up along the lines 54*a*. As the loading chute is raised even further, the lading spills over the baffle members 134, 136 and down onto the 54*a* lading layer and the car is then filled up to the extent desired, forming a final lading line 56.

Unloading is carried out by gravity through outlet 122, for example, utilizing a generally horizontal conveyer. Unloading occurs first in the hopper section below baffles 152 and 154. The lading from above fills this hopper section by passing between baffles 152 and 154, and by passing between the baffles and the side and end walls of the hopper. A similar pattern is followed as the lading passes between and around baffles 134 and 136. A relatively small percentage of the lading is believed to discharge through openings in the baffles.

If desired, either baffles 134 and 136, and/or baffles 152 and 154 may be removed from the hopper and stored if it is desired to carry a lading wherein baffles are not required. If this is to be done, it is preferred that all baffle support connections to the hopper be of the non-permanent type i.e., nuts and bolts, clamps, etc. However, if the baffles are not removed and the hopper is used with a product like grain where its angle of repose is equal or less than the angle of the baffles, the hoppers will fill and empty as described above and little volume will be lost. Therefore the baffles can remain in the hopper for commodities not susceptible to damage by deep piling.

Figure 10A:
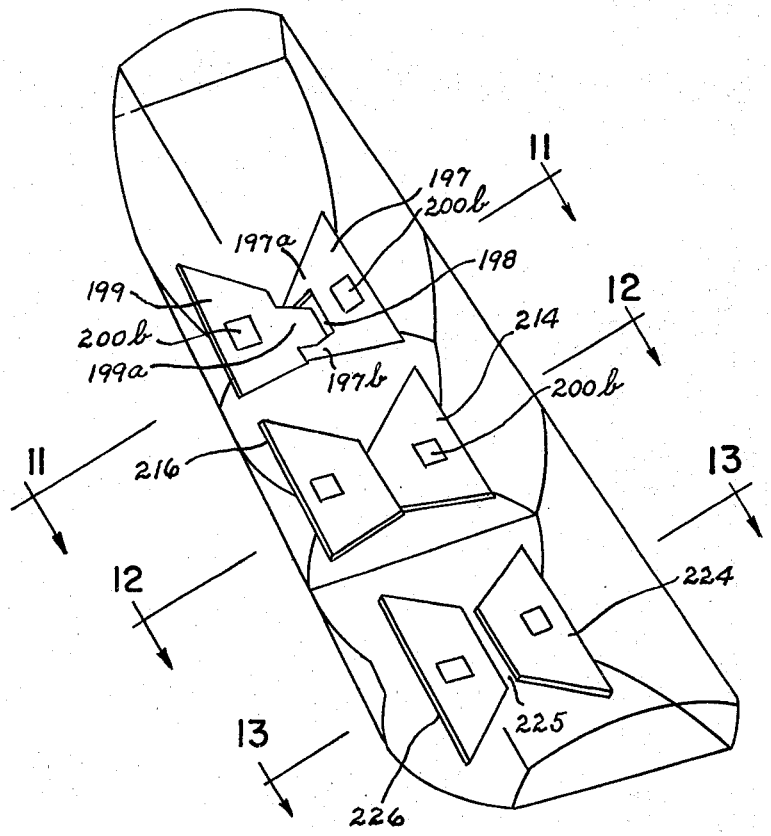
FIG. 10A is a schematic perspective view illustrating three embodiments of a two level baffle system illustrating the upper baffles of the system.
Figure 10:
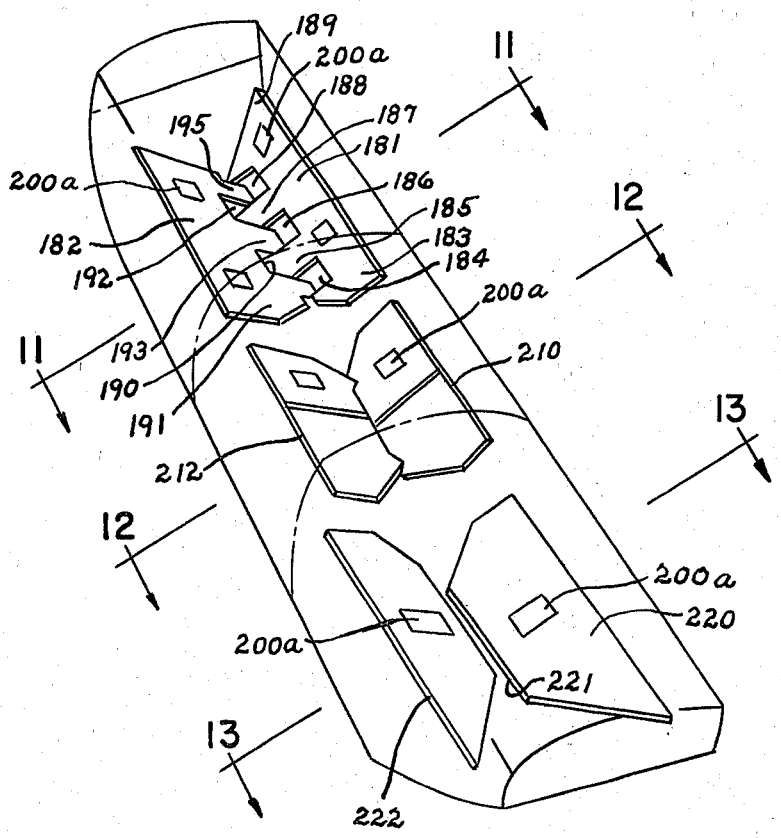
FIG. 10 is a schematic perspective view illustrating three embodiments of a two level baffle system illustrating lower baffles of the system.
Figure 13:
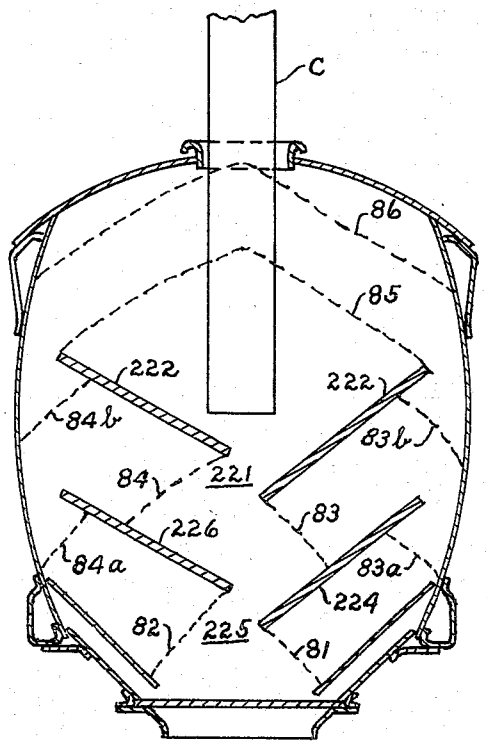
FIG. 13 is a view along the line 13—13 in FIG. 10.

FIGS. 10 and 13 illustrate several embodiments of the present invention as applied to a two level baffle system. In the embodiment shown in FIGS. 10 and 11, upper baffle members 181 and 182 have downwardly extending portions respectively, 183, 185, 187 and 189; and 191, 193, 195. Openings 184, 186, 188; and 190 and 192 are defined thereby. In the respectively lower baffle system, baffle members 197 and 199 have downwardly extending portions 197*a*, 197*b;* and 199*a* which define an opening 198.

Considering first the loading operation for the embodiments shown in FIG. 11, it will be apparent that the loading chute C can not pass downwardly below the upper baffles. Therefore the lading has to drop the respective baffles 181 to 199; and 182 to 197 to the bottom. The lading thus assumes initial lines 61, 62. If openings are not provided in the baffles, the lading next assumes a position 63, 64. Then as the loading chute is raised, the lading will assume a position 65, after which the lading must drop a long distance from respective baffle members 181 and 182 to piles 61 and 62. Thus, to facilitate loading, it is preferred to provide the lower and upper baffles respectively with openings 200*a* and 200*b*, as shown in FIG. 10.

If openings are provided in baffles 197 and 199, the second lading position is indicated by the lines 63*a*, 64*a*. Similarly, if openings are provided in baffles 181 and 182, the lading will assume positions 63*b*, and 64*b* as the chute is raised upwardly above baffles 181, 182. Then, when the lading between the baffles assumes the position indicated at 65, the lading has a much shorter drop after going around baffles 181 and 182. Thus considerably less lading damage can be obtained by providing openings in the embodiment shown in FIG. 11. The final lading contour is indicated by the line 66.

During unloading, the lading passes through openings 184, 186 and 188 in the upper level and between the upper baffles and the sides and end hopper sheets. In the lower lever the lading passes through openings 198 and between the lower baffles and the sides and end hopper sheets. This embodiment unloads very well because of the staggered relationship which defines the openings 184, 186, 188 and 198. However, this design is more difficult to fabricate in production quantities and more difficult and expensive to clean than some of the other embodiments with two levels.

In the embodiment shown in FIGS. 10 and 12, cooperating upper platens 210 and 212 are spaced from one another with platen 210 extending below plate 212 to define an opening 210*a*. Similarly at the lower level, platen 214 extends below platen 216 and an opening 214*a* define. It will be apparent that the end portion 211 of plate 210 is substantially below the end portion 213 of platen 212, preferably 10 to 16 inches. Similarly the end portion 215 of platen 214 is substantially below the end portion 217 of platen 216, preferably 10 to 16 inches.

Figure 12:
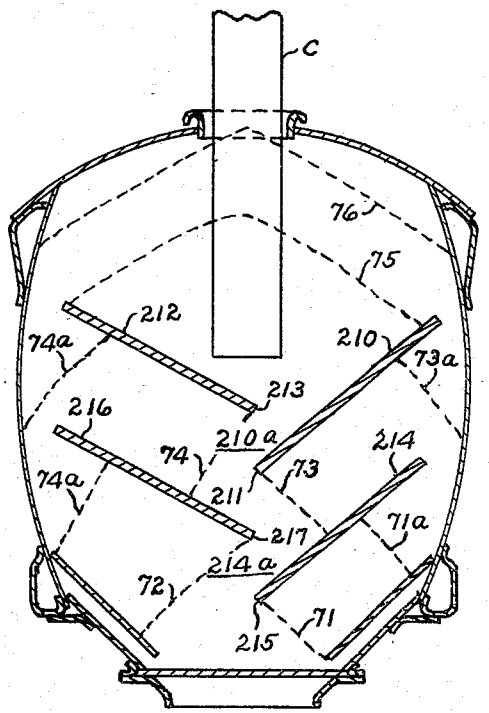
FIG. 12 is a veiw along the line 12—12 in FIG. 10.
Figure 11:
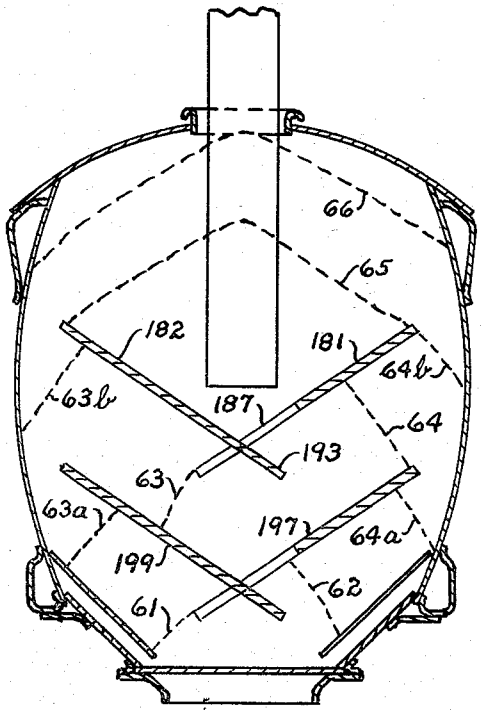
FIG. 11 is a view along the line 11—11 in FIG. 10.

The embodiment shown in FIG. 12 is an attempt to reduce the long drop between baffle members 193, 197 and 187, 199 in FIG. 11. Also, it is an attempt to eliminate the vertical transmission of lading pressure down through the hopper that is present in the arrangement of FIGS. 6, 7, 8 and 9. In the embodiment of FIGS. 6, 7, 8 and 9 there is a substantial horizontal distance (for example approximately 20 inches) between the baffles 152 and 154 and between 134 and 136 to accommodate the loading chute, viewing down through the hopper, and the hopper spray washing nozzle. However, this is large enough to also allow the transmission of significant pressure from the lading above the baffles to the lading below the baffles. The arrangement of FIGS. 11 and 12 eliminates this vertical transmission of pressure through the center area. Here again the lading chute C can not be lowered to the bottom of the hopper unless the baffles are equipped with access doors as described hereinafter. The lading is initially unloaded on baffles 212 and then it drops to baffle 210, then to 216, then to 214 until the bottom. Initial lading positions are indicated by the lines 71, 72. As the car fills up further, the lading assumes the positions shown at 73 and 74. As the chute is raised, the lading then assumes the position indicated at 75. However, it will be noted that there is a long drop for the lading to take from the outside of baffles 210, 212 down to respective lines 71 and 72.

If openings are provided in baffle members 214 and 216 then the second lading position is indicated at 71*a* and 72*a*. If openings are provided in baffle members 210 and 212, then the third lading position is indicated by the lines 74*a* and 73*a*. It will thus be apparent that when the chute is raised and the lading begins to drop over baffle 210 and 212, the drop is much less. It is thus apparent that the design shown in FIG. 12 is preferably provided with baffle openings.

In unloading this embodiment the lading passes between and around baffles 214 and 216, and between and around upper baffles 210 and 212. In the embodiment shown in FIGS. 10 and 13, baffle members 220 and 222 are spaced from each other, preferably a distance of about 3 inches to 6 inches to define an opening 221. Similarly lower baffle members 224 and 226 are spaced from each other a similar distance to define an opening 225. The FIG. 13 arrangement provides this small horizontal opening between the baffles for viewing some of the lower portions of the hopper and for an access opening for a spray washing nozzle. The 3 inches to 6 inches opening in small enough to prevent any significant transmittal of vertical pressure to the lading below the baffles. It will also be apparent from FIG. 13 that baffles 200 and 224 are somewhat longer than baffles 222 and 226 and thus extend somewhat below respectively baffles 222 and 226, preferably 10 to 16 inches.

Notwithstanding the fact that baffle members 220 and 222, and 224 and 226 are spaced from each other there still is insufficient room for lading hoist C to pass through. Thus again the lading must take the tortuous bouncing path of baffle 222 to 220 and/or 226 and 224. The initial lading positions are shown at 81 and 82. If no openings are provided in the baffles, the next lading position is illustrated by lines 83 and 84. As the chute is raised the lading assumes a position 85 between baffles 220 and 222. Again without openings, there is a long drop down to the respective sides of the hopper. However, if openings are provided in the baffle member 220, 222, 224 and 226, the second and fourth lading positions are shown at 83*a* and 84*a* and 83*b*, 84*b*. Thus when the lading reaches the position indicated by line 85, the drop around baffles 220 and 222 is much less, about one (1) to two (2) feet. The final lading contour is indicated by the line 86.

Unloading this embodiment is similar to the previous embodiment; the lading passes between and around baffles 224 and 226, and between and around baffles 220 and 222.

Figure 13A:
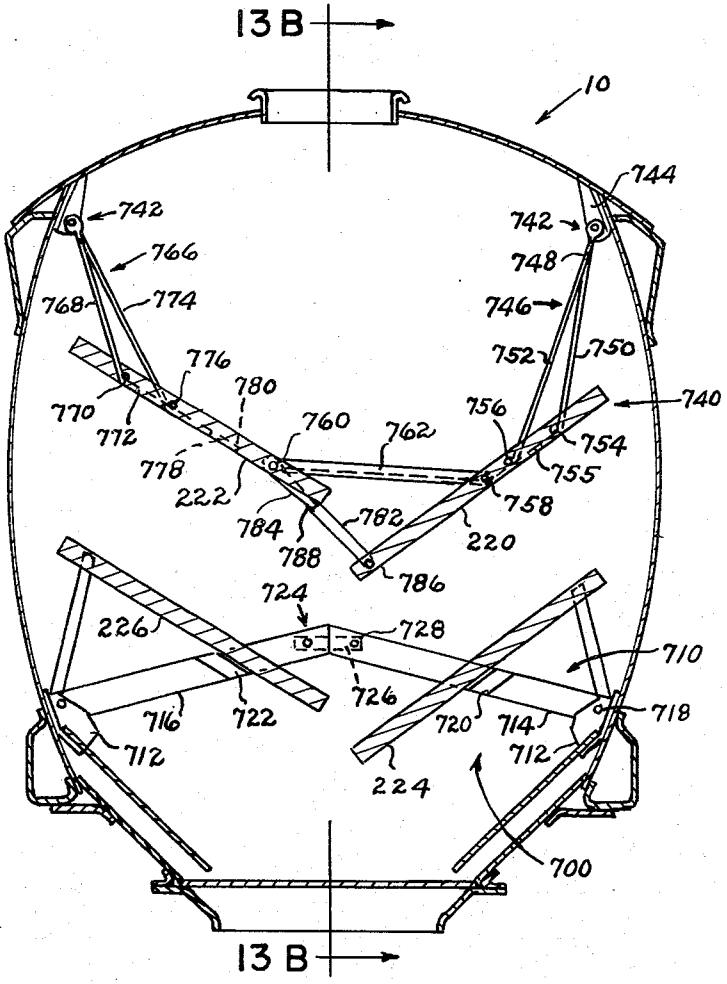
FIG. 13A is a transverse section illustrating one type of baffle support structure which may be used for the embodiments shown in FIGS. 10–13 of the drawings.
Figure 13B:
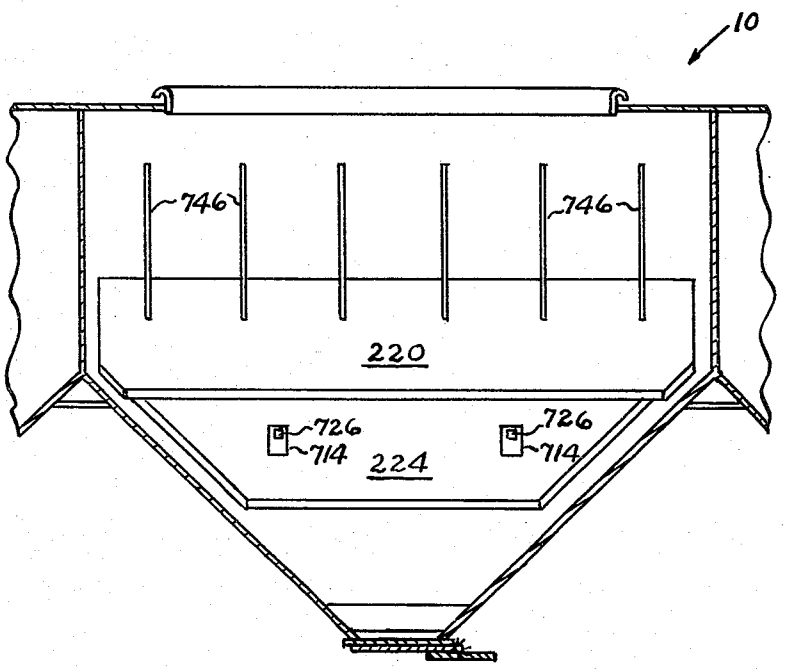
FIG. 13B is a view along the lines 13B—13B in FIG. 13A.

It will be noted that in the embodiment shown in FIGS. 10 to 13, the support structure for the baffles has been eliminated from the drawings for the sake of simplicity. It will be also noted that in all cases the baffles are spaced from the side of the hopper to facilitate loading through the side portion of the hopper, as discussed above. However, as an example of one baffle support system which may be utilized for the embodiment shown in FIGS. 10–13, reference may be made to FIGS. 13A and 13B. The baffle support system is indicated generally at 700 and comprises a lower baffle support system 710 and an upper baffle support system 750. Lower baffle system 710 includes brackets 712 affixed to opposite sides of the inwardly extending support arms 714 and 716 are appropriately affixed thereto by means of fasteners 718. Affixed to the respective arms 714 and 716 are leg supports 720 and 722. The lower baffle members shown in FIGS. 10–13 are then affixed to the supports 720 and 722. If desired, support arms 714 and 716 may extend inwardly and be joined together at about their mid points by means of appropriate fasteners indicated generally at 724, for example, this may comprise a splice 726 and appropriate fasteners, for example, bolts 728 affixed to the respective members 714 and 716.

Upper baffle support means 740 may comprise a plurality of chain shackle 742 affixed to brackets 744 mounted on the hopper slope sheet. Supporting chains or ropes 746 are then affixed in the shackle. Chains or ropes are affixed to shackle 742 with appropriate fasteners 748. The chains or ropes 746 preferably comprise two members 750 and 752. Member 750 preferably is wound around a strong point 754 and affixed to rope or chain 752 by means of cable clamps at 756. The outer rope or chain member 752 passes around a strong point 756 around another strong point 758 and extends inwardly and engages a strong point 760 and a turnbuckle adjustment 778 on the left side baffle means in FIG. 15. In this fashion, chain or rope 752 is utilized to support a center spacer 762, for example, a circular section.

The left had chain or rope 766 comprises a first chain 768 which passes around a strong point 770 and then is affixed to the rope or chain 774 with clamps at 772. The other chain or rope member 774 passes around a strong point 776 and is affixed to a turnbuckle 778 by means of a heavy duty thimble and cable clamps. The turnbuckle 778 thus join the support arrangement for both upper baffles and provides a means of tightening both baffles. Center spacer 782 is affixed to the chain or rope 784 which rotates about strong point 760. The chain or rope 784 passes around strong point 786 on the right hand baffle member and stroking point 760 on the left hand baffle and is held together by means of U-bolts 788.

It will be apparent that particularly the upper portion of these baffles by means of the rope and cable clamp system can be readily adjusted for height and baffle slope for testing various arrangements or can be removed in the event that they are not required for certain lading. However, for many application, it may be desirable to utilize instead of the rope or chains to support the upper baffle rigid metallic arms along the lines illustrated, for example, in FIG. 15 and in FIGS. 19–22.

Figures 14, 14A, 14B:
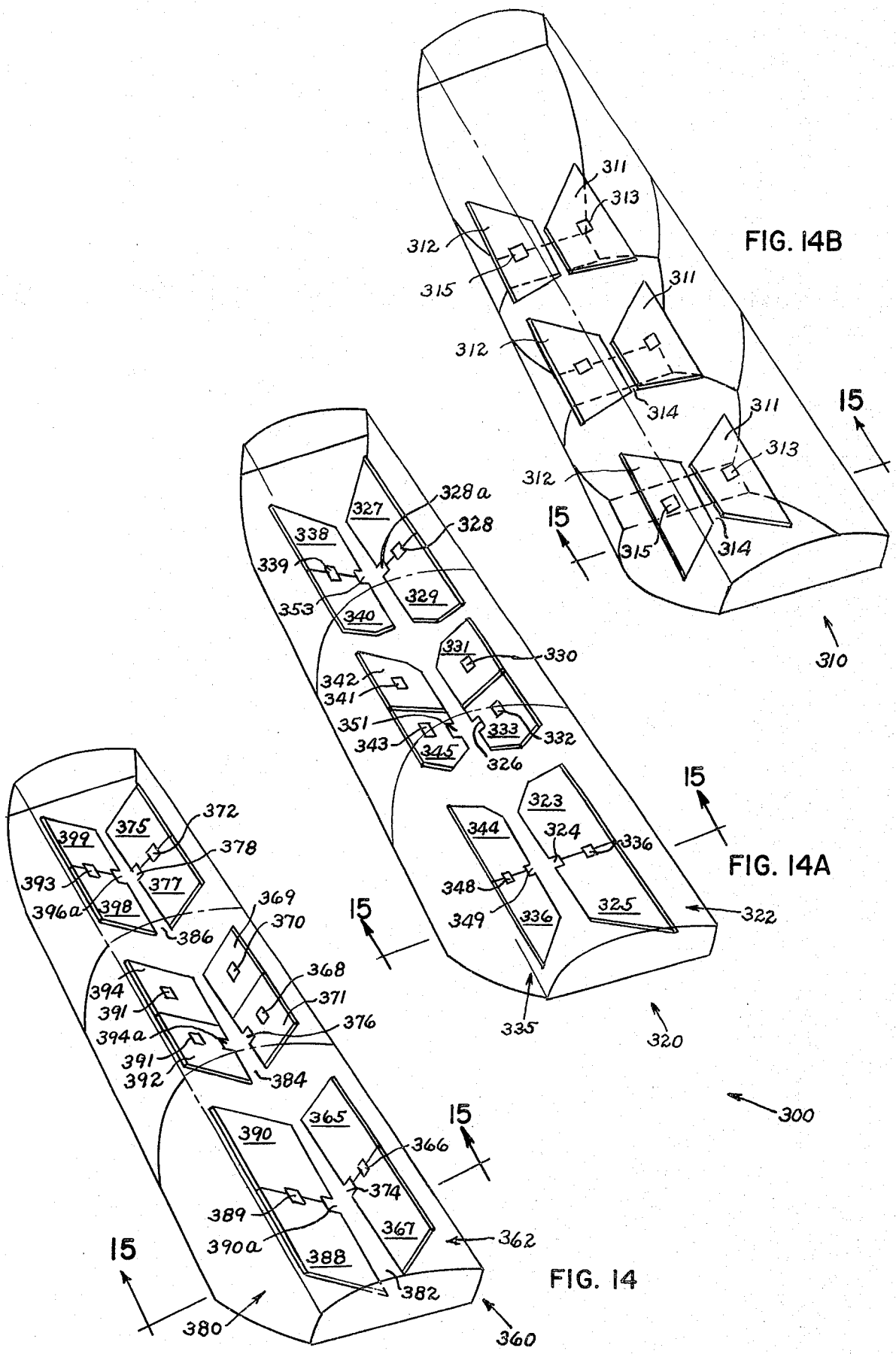
FIG. 14 is a schematic perspective view of a three level embodiment of the present invention illustrating the lower baffle level.
FIG. 14A is a schematic perspective view of a three level embodiment illustrating the intermediate level.
FIG. 14B is a schematic perspective view of a three level embodiment illustrating the top level of the baffles.
Figure 15:
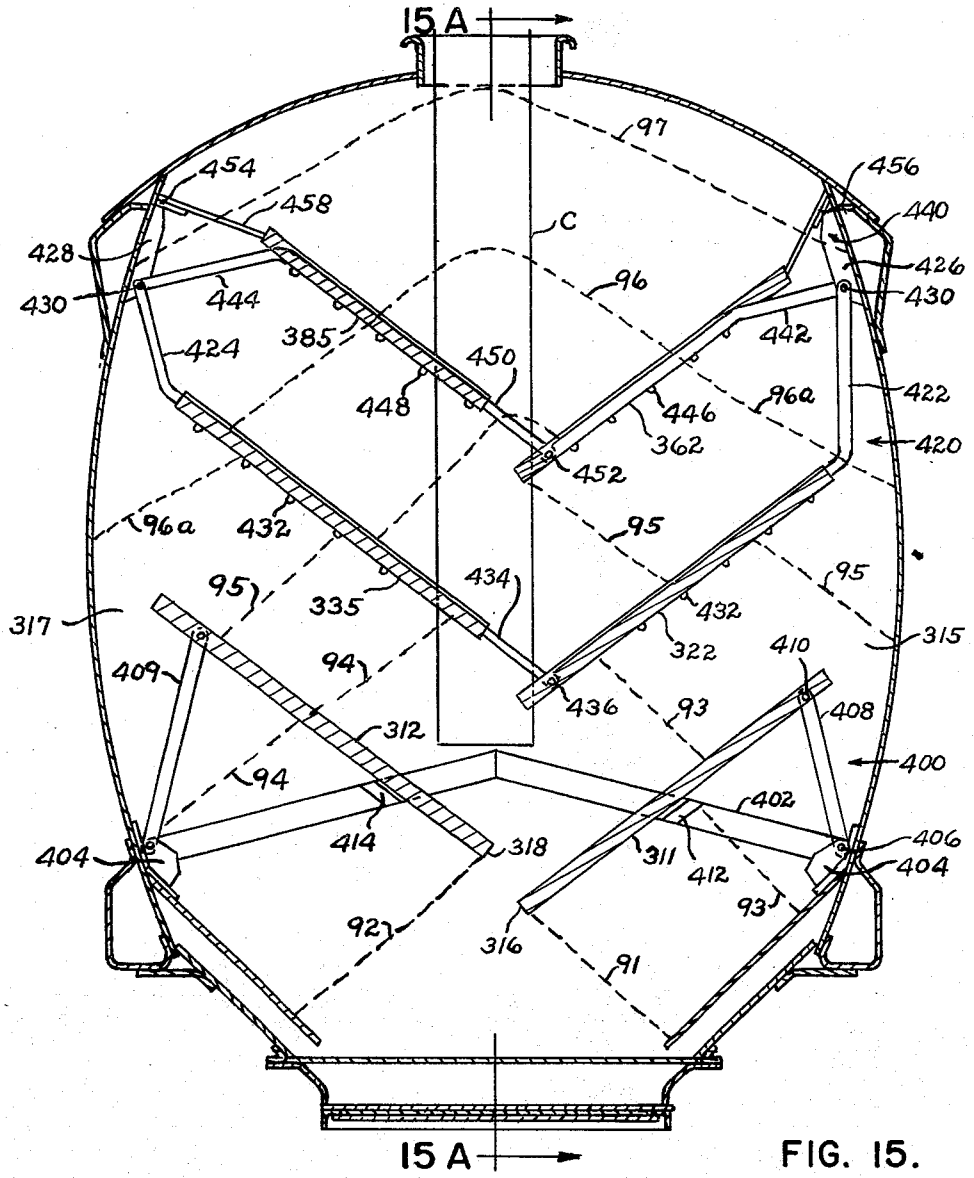
FIG. 15 is a veiw along the line 15—15 in FIG. 14.

In FIGS. 14 and 15 a three level embodiment is illustrated. The three level embodiment is indicated generally in FIG. 14 at 300 and comprises a lower baffle layer indicated generally at 310, an intermediate baffle layaer indicated generally at 320 and an upper baffle level indicated generally at 360.

Lower baffle level 310 may comprise lower baffle members 311 and 312. While the contour of the lower baffles in the respective hoppers may vary widely, if desired, preferably the contour of the lower baffles is substantially the same for ease of manufacture. The baffles also preferably include openings therein 313 and 315, preferably 8 to 12 inches to facilitate loading of the lading. It is preferred to provide one set of lower baffle members for each hopper as illustrated in FIG. 14. As was previously described, it is preferred lower baffles be spaced from the walls to define openings 315 and 317 to facilitate loading the lower portions of the hoppers, preferably 8 to 12 inches. It will be noted that baffle members 311 and 312 are laterallly spaced from one another, for example, up to six (6) inches to define an opening 314. It will also be noted that the end portion 316 of baffle 311 extends below the end portion 318 of baffle 312, for example, 10 20 inches. Obviously, this could be reversed, if desired.

Figure 15A:
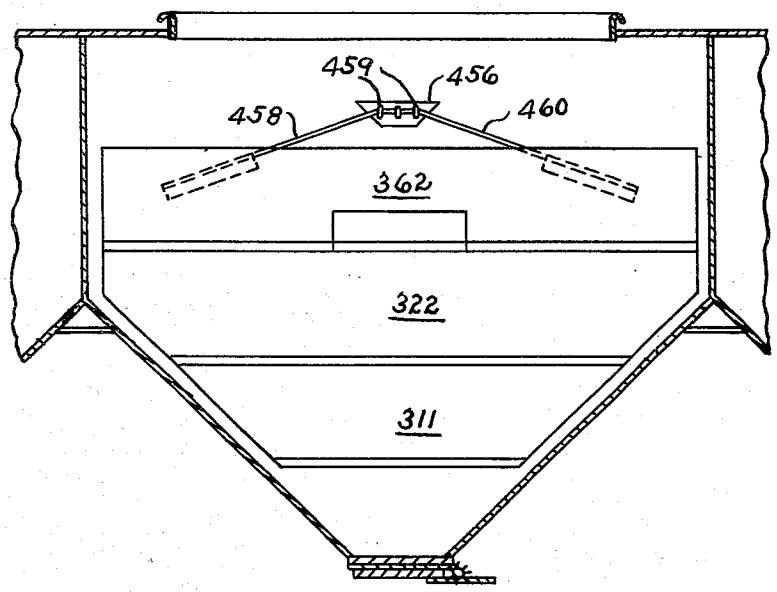
FIG. 15A is a view along the line 15A—15A in FIG. 15.
Figure 16:
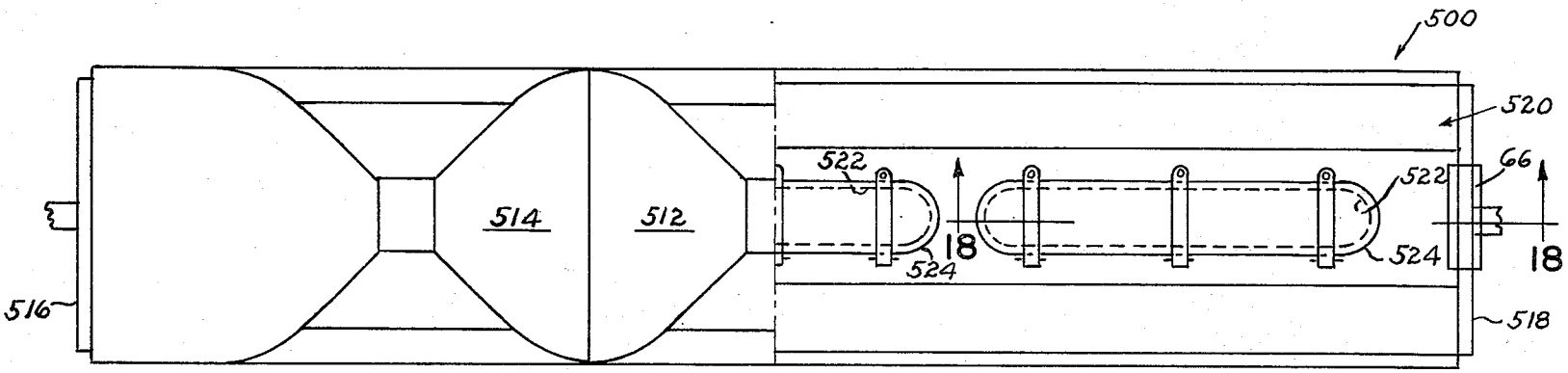
FIG. 16 is a top view of a railway hopper car utilizing a three level baffle arrangement in accordance with one embodiment of the present invention.

In general, intermediate baffles 320 comprise a right hand portion indicated generally at 322 and a left hand portion indicated generally at 335 spaced from each other as shown in FIG. 15, for example, up to 6 inches. Also, the right hand baffles 322 extend below the left hand baffles 335, for example, about 10 to 12 inches. Obviously, this could be reversed, if desired. Right hand baffles 322 comprise baffle members 323, 325, 327, 329, 331 and 333. Two of these baffle portions are found in each hopper. These baffle members may be made of one or more pieces of material. However, it is often convenient to weld or bolt together the members to an intermediate support, such as 422 in FIG. 15. Two of the members may define one or more openings indicated at 336, 330, and 332, 328, for example, of about 8 to 12 inches. These openings are provided to facilitate lading loading. Also preferably provided in the baffle members are doors 324, 326 and 328*a*. The doors are of a convenient size to allow loading chutes or conveyers to be lowered to just above lower baffle members 310. An exemplary door is shown in FIG. 15A. It is preferred to have doors of a size of the same order of magnitude as the hatch so that at least most material which can be loaded through the hatch can be lowered through the doors.

Similarly, the left baffle means may comprise both baffle members 336, 344, 345, 342, 338 and 340. These portions preferably define openings 348, 343, 341 and 339. Doors 349, 351 and 353 are also preferably provided to facilitate lading loading. Left door 349 and right door 324 cooperate as do doors 351 and 326; and 353 and 328.

Upper baffle means 360 comprise a right hand portion indicated generally at 362. Right hand baffle means 362 are found in each of the hoppers and may comprise baffle members 365, 367, 369, 371 and 375, 377. These baffles preferably define openings 366, 368, 370 and 372. Also doors 374, 376 and 378 are preferably provided for lowering loading chute C to just above lower baffle members 312. If desired, doors could also be provided in lower baffles 311 and 312. However, it is believed that for many applications involving perishable lading this would not be necessary.

It will be noted from FIG. 15 that right hand baffle means 362 extend below left hand baffle means 385, for example, about 10 to 16 inches. The left hand upper baffle means are indicated generally at 385. The left hand baffle means 385 are spaced from the right hand baffle means 362 to define openings 382, 384 and 386.

The baffle means 385 may comprise individual members in each of the hoppers comprise members 388, 390, 392, 394, 398 and 399. Again, openings are preferably defined therebetween 389, 391 and 393. Doors 390*a*, 394*a* and 396*a* are preferably provided to facilitate lowering of chute C. The size of openings, the baffle spacing and door size for the third level are preferably within the range hereinbefore described for the lower levels.

Appropriate support structure for the three baffle levels is also provided. This support structure may take various forms. An example of such support structure is shown in FIG. 15 but this exemplary support structure is not to be considered limiting.

The support structure for the lower baffles is indicated generally at 400 and comprises support legs 402 affixed to lower support brackets 404 by appropriate fasteners, such as bolts 406. For example, four of these support members 402 may be provided longitudinally in each hopper. The cross section of the support legs may be an angle, channel or box section. For example, a box section is indicated in FIG. 15. Also affixed to brackets 404 are auxiliary supports 408 and 409 which are appropriately fixed to baffles 331 and 312, for example, by bolts 410. Mounted upon main support legs 402 are leg support members 412 on the right side and 414 on the left. These leg supports respectively support baffles 311 and 312 in the positions shown in FIGS. 14 and 15.

The intermediate level support means is indicated generally at 420 and comprises depending arms 422 and 424 which are affixed respectively to brackets 426 and 428 by appropriate means, for example, bolts 430. In the embodiment shown in FIGS. 14 and 15, considering the front baffle members 323 and 325, these are respectively affixed to arms 422 on opposite sides thereof by means of appropriate fasteners 432. Similarly, baffle members 344 and 336 are affixed to opposite sides of arm 424. The other intermediate baffle members are preferably similarly affixed to depending arms 422 and 424. Additionally, arm 424 preferably has an extension 434 which is joined to arm 422, for example, by means of bolts 436. This intermediate connection makes the intermediate connection makes the intermediate baffles more rigid and secure.

The upper baffle support means are indicated generally at 440 and comprises outwardly extending arms 442 and 444 which are also affixed to brackets 426 and 428 with appropriate fasteners, for instance bolts 430. As was the case with the intermediate baffles, considering baffle members 615 and 617, for example, these are affixed to arm 442 by means of appropriate fasteners, such as bolts 446. Similarly, baffle members 388 and 390 are affixed to arm 444 by means of fasteners 448. The other upper baffle members are preferably similarly affixed to arms 442 and 444. Arm 444 preferably has an extension 450 which joins arm 442 by means of fasteners 452 to provide added rigidity to the upper baffles.

Mounting brackets 454 and 456 are provided longitudinally along the car and affixed thereto by appropriate fastening means 459 as shown in FIG. 15B is wire rope or chains 458 and 460. The wire rope or chains are affixed to upper baffles 362 and 380 to provide support against longitudinal movement of the upper baffles during impacts.

The first step in the loading sequence in the embodiment shown in FIGS. 14 and 15 is to open the doors 379 and 390a and 324 and 349. Then the lading conveyer or chute C may be lowered to a point just above baffles 311 and 312. Loading begins and the lading assumes initial positions 91 and 92. As the chute is raised, the lading then assumes positions 93 and 94 above baffles 311 and 312. Since openings are provided in baffle members 311 and 312, the lines 93 and 94 are continued below baffle members 312 and 311. As the chute is raised above baffle members 323–325 and 344–336 doors 324 and 349 are closed. As the loading conveyer is raised further, the lading assumes the position shown by the line 95. Note that line 95 extends below baffle members 323–325 and 344–336 because of the openings therein. As the loading conveyer is raised further, the doors 379 and **390*a* are closed. As the chute is raised further and loading continues, the lading defines line 96. In defining the line 96 it is noted that the lading must drop over baffles 323–325 and 344–336 down to line 95. Also, in forming the line 96, the lading passes through openings 366 and 389 to define a portion 96*a*. As the loading chute is raised further the lading passes over the end portions of baffles 617–615 and 388–390 and assumes a final contour 97**. The other hoppers are similarly loaded.

It will be thus apparent that the utilization of the doors to allow lowering of the loading conveyer and openings to reduce the drop that the lading must take from level to level effectively minimizes damage and allows good control of the loading operation since the loading conveyer can be moved to a point just above lower baffle members 311 and 312. If desired, doors could be provided on these baffles, however, experience has not indicated that such is necessary for many perishable ladings because only minimal droppage occurs and this occurs to only a small quantity of lading (generally less than about 500 pounds).

As in the preceding embodiments, unloading proceed by gravity. A horizontally extending conveyer is preferably provided. The lading below the lower baffles unloads first. Lading is replaced in this area from above by passing between end portions 316 and 318 and between the baffles and the sides and end portions of the hopper. The majority of the lading from above passes in the center section between baffles 322 and 335, although some passes around them. This also holds true for upper baffles 362 and 385. A small percentage, generally less than 5% passes through the baffle openings.

In the embodiment shown in FIGS. 16–19, a railway car is indicated generally at 500. The railway car is provided with trucks 502 and wheels 504 for moving the car along standard rail tracks. The car is also provided with side sills 506 and side plates 508 (FIG. 19) and conventional end sections 516 and 518. A roof 520 is provided with a plurality of hatch openings 522. The openings 522 are provided with hatch covers 524 for opening and closing openings 522 for loading the car. The car comprises a plurality of hoppers 510, 512 and 514 divided by transverse bulkheads 511 and 513. Each of the hoppers 510, 512 and 514 are provided hopper outlets 515 of known construction for unloading the car. Reference may be made to U.S. Pat. 3,486,241 for further construction details in regard to the hopper car construction which patent is hereby incorporated into the present application by reference.

Figure 17:
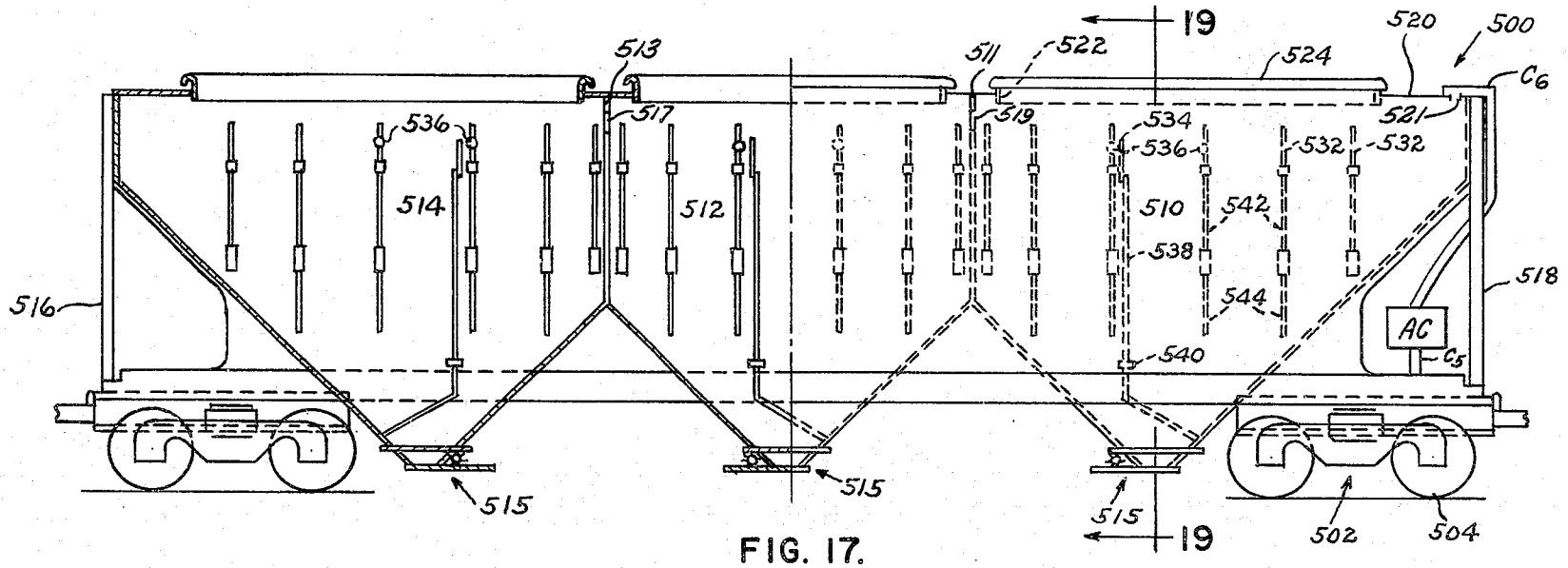
FIG. 17 is a side view of the railway car shown in FIG. 16.

A plurality of support brackets 532 and 534 are provided longitudinally along the car in the upper portion thereof as indicated in FIG. 17. Spanning the upper portion of the car and affixed to the brackets 532 are a plurality of stiffeners or spanners 536. In each hopper on opposite sides thereof affixed to bracket 534 are vertical stringers or stiffeners 538. Vertical stringers 538 are affixed to the lower portion of the hopper with appropriate fasteners 540. Stringers 538 may comprise a pipe channel or box section as desired. Stringers 538 are utilized to absorb shock and fix the lower two levels of baffles 544, 560, 636, 642 from horizontal impact forces during car movement.

Figure 21A:
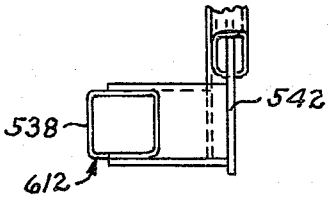
FIG. 21A is a plan view of FIG. 21.
Figure 21:
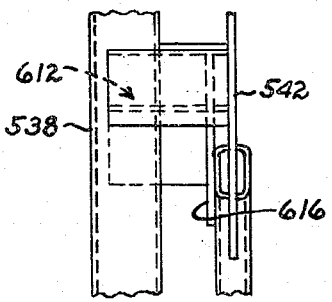
FIG. 21 is a veiw along the line 21—21 in FIG. 20.

Also affixed to brackets 532 with appropriate fasteners are arms 542 and 632 which preferably have an inward extension 544 and 636 toward the center of the car. Vertical struts 538 are affixed to vertical arms 542 and 632 at 610 by means of box structure 612 shown in FIGS. 21 and 21A.

Figure 20:
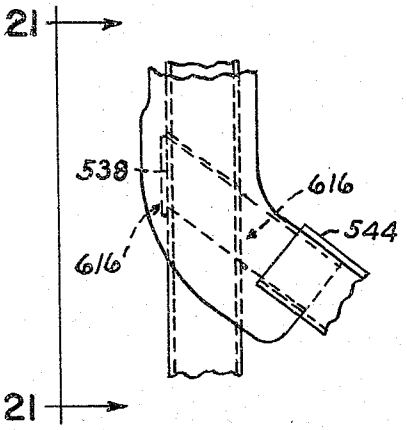
FIG. 20 is a view along the line 20—20 in FIG. 19.

Furthermore, vertical strut 538 is affixed to inward extension 544 at 614, as shown more clearly in FIG. 20, by means of an extension members 616.

Figure 18:
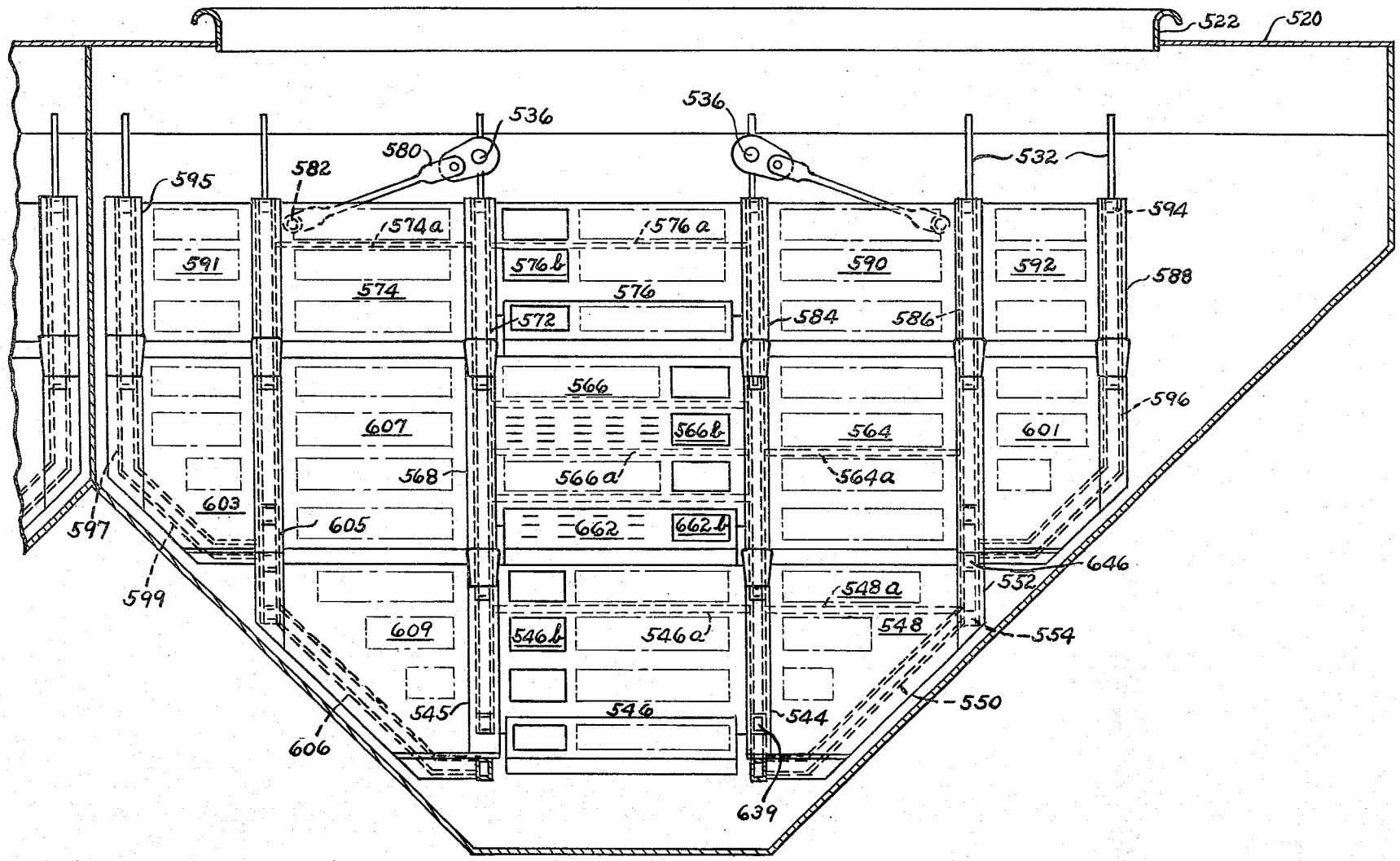
FIG. 18 is a view along the line 18—18 in FIG. 16.

Baffle members 546 and 548 are affixed on opposite sides to arm 544. Baffles 546 and 548 may be provided with appropriate stiffeners **546*a* and 548*a*. As shown in FIG. 18, baffle member 546 may be provided with openings 546***b* to facilitate lading loading. It will be apparent that baffle member 546 is also affixed to another arm extension 545 as can be seen in FIG. 18. Similarly, baffle member 548 is affixed to a baffle support or arm 550 which depends angularly from a depending arm 552 by welding or appropriate fasteners as indicated at 554.

Figure 19:
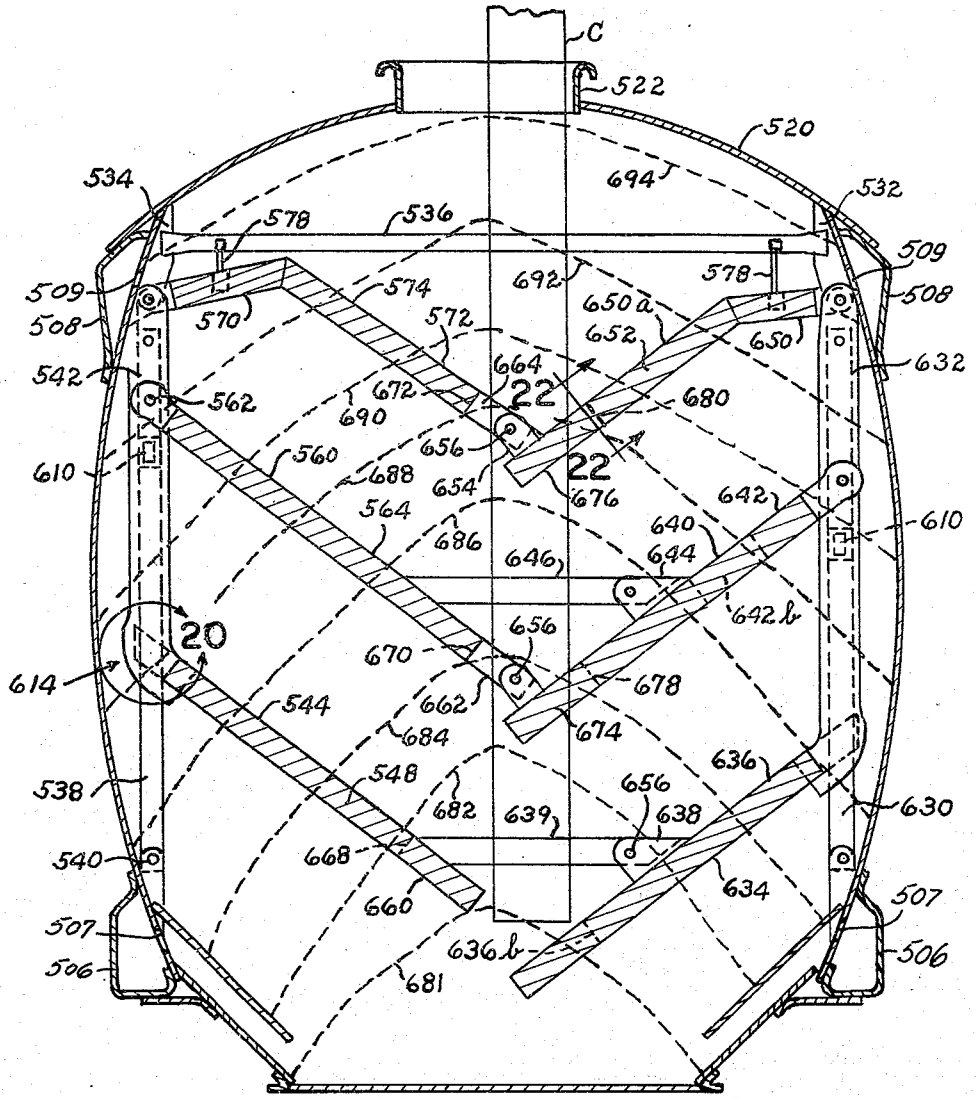
FIG. 19 is a view along the line 19—19 in FIG. 17.

Shown in FIG. 19, arm 542 has affixed thereto intermediate extensions 560 held in place by appropriate fasteners 562. Thus, baffle members 564 and 566 are affixed with appropriate fasteners to extension 560. Baffle member 564 is also affixed to baffle support or arm 553, affixed to arm 552.

As stated hereinbefore, selected baffles may have openings of a size sufficient for the lading to pass through. Also the doors may have similar openings. The baffles and doors may have slots provided to allow air flow. These openings and slots are clearly shown in FIGS. 18A and 18B. The sizes of the loading openings, doors, air flow openings and baffle spacing are preferably within the ranges given hereinbefore for these respectively parameters.

As described in U.S. Pat. 3,486,241, an air conditioning unit A.C. may be mounted on one end of the car (FIG. 17). Conditioned air may pass into the side sills 506 through conduits $C_5$ and then through openings 507 in the side sills into the hoper body and downwardly below guide plates 507*a* toward outlets 515. The air then passes upwardly through the three layers of baffles, passing both between the baffles and/or through lading openings in the baffles and/or doors, and through air flow slots provided in the baffles and/or the doors of the baffles. The air then passes longitudinally in the car. Air from hoppers 514 and 512 passes through openings 517 and 519 respectively in bulkheads 513 and 511 and is returned to air conditioning unit A.C. through an opening 521 in the roof in communication with return conduit C6 for further circulation. Alternatively, as described in U.S. Pat. No. 3,486,241, the conditioned air may be returned through openings 509 in the side sheet and then through hollow side plates 508. As is also described in the '241 patent, the air may also be circulated in the opposite direction.

Figure 18A:
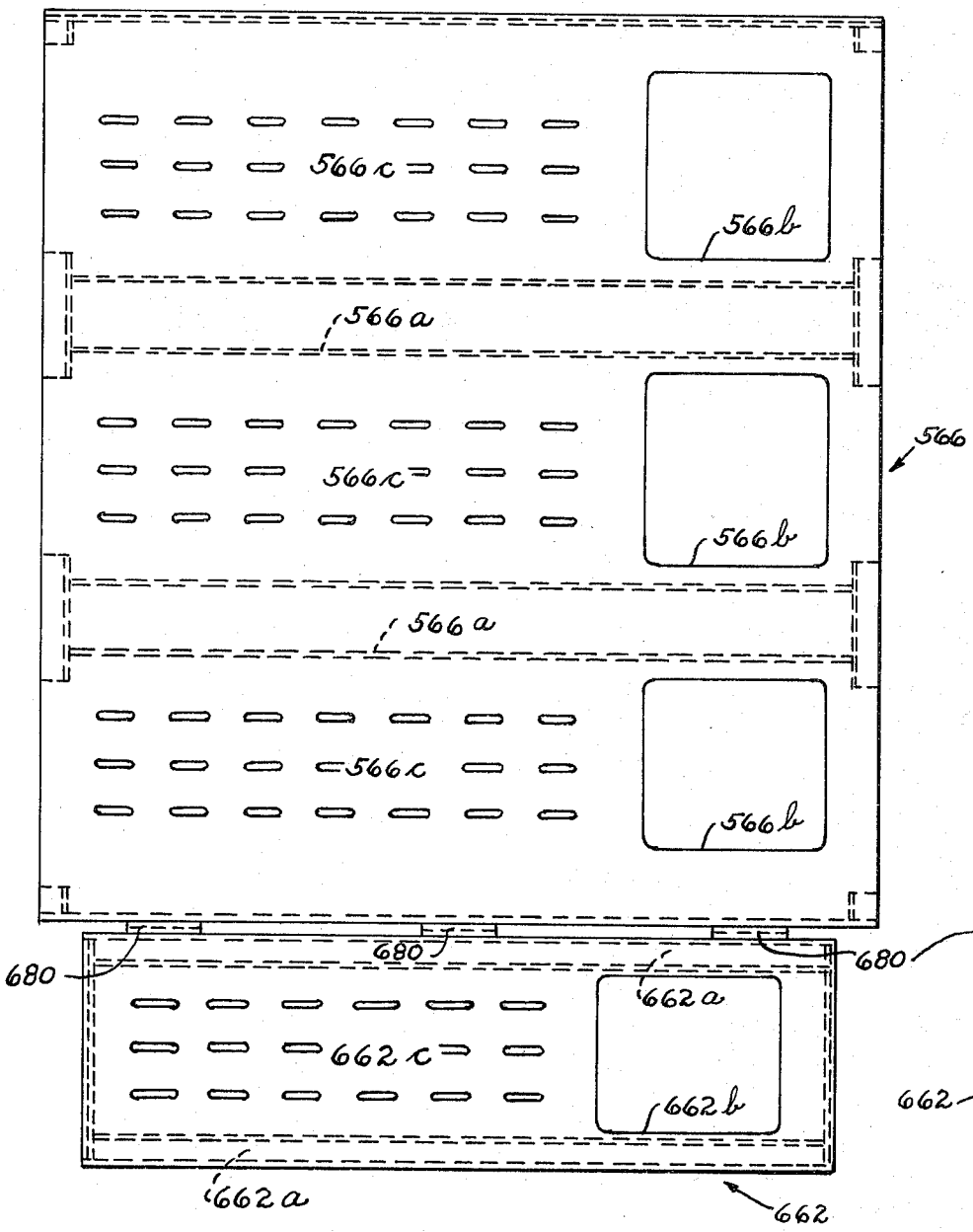
FIG. 18A is an enlarged view of baffle 566 and its companion door 662 shown in FIG. 18.
Figure 18B:
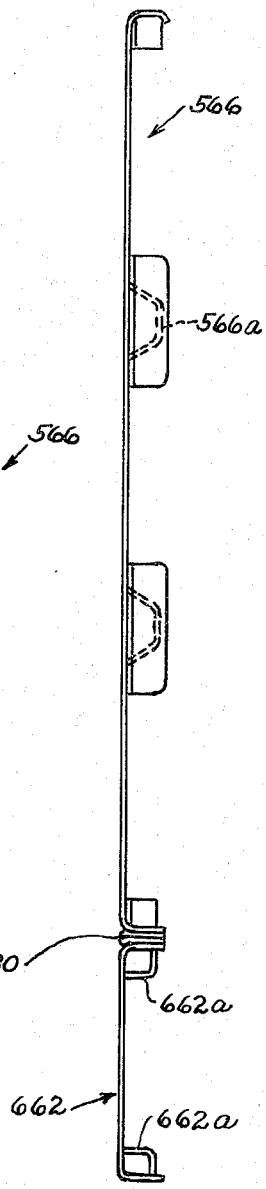
FIG. 18B is a side elevation of FIG. 18A.

FIGS. 18A and 18B are an enlarged view of baffle 566 and its door 662 in FIG. 18, showing stiffeners 566*a* and 662*a*, and also showing openings 566*b* and 662*b*. The baffle 566 is provided with a multitude of slots 566*c* for air flow. The door 662 is provided with slots 662*c* for air flow. It is to be understood that all baffles and doors shown in FIG. 18 may have openings or slots are required to provide air flow if desired. Baffles 564 and 566 respectively are provided with stiffeners 564*a* and 566*a*. Baffle 655 is preferably provided with openings 566B to facilitate loading. On its opposite or left side in FIG. 18, baffle 566 is affixed to an arm or extension 568 similar to extension 560 in FIG. 19. As shown in FIG. 19, also affixed to bracket 532 is an upper baffle support 570. Baffle support 570 has a depending extension 572 having affixed thereto baffle members 574 and 576. Appropriate stiffeners 574*a* and 576*a* may also be provided. Baffle 576 may have openings therein 576*b* to facilitate lading loading. Affixed, for example, by means of a clevis 580, to transverse spanner 536 is a tie rod baffle support member 578, affixed with clevis 582 to the baffles.

An outwardly extending arm 584 is provided similar to arm 572 onto which baffle 576 is affixed on the right side thereof in FIG. 18. Additional vertical depending arms 586–589 are provided similar to arm 572, upon which are affixed baffle members 590–592. Also, at the ends of the hopper support members 594 and 595 similar to member 560 have angle portions 596 and 597 similar to angle portion 550. Also depending legs 598 and 599 are provided below angle portions 596 and 597 respectively. In this manner support for baffles 601 and 603 and 595 is provided. A depending arm arrangement 605–606 similar to arms 550–552 is provided to support baffles 607 and 609.

It will be apparent from FIG. 19 that on the other side of the car a vertical stiffener or beam 630 is provided similar to 538. Furthermore, a depending arm 632 similar to arm 542 has an extension 634 similar to extension 544. Baffle membes indicated at 636 are affixed to either side of extension 634 similar to the left side arrangement. The baffles may have stiffeners 636*a*, and openings 636*b* for lading loading. An arm 640 is affixed to arm 632 havng baffles affixed thereto 642. Similarly, an arm 650 is affixed to bracket 534 having a depending extension 650*a* having baffles 652 affixed thereto. Extension 634 and arms 640 and 650*a* are provided with brackets 638, 644, 654 adapted to receive generally horizontal extensions 639 and 646 and depending angular extensions 560 and 572 with appropriate fasteners 656. These interconnections strengthen and stabilize the baffles under load. Horizontal extensions 646 and 639 are raised to keep sufficiently away from the sloping floor sheets to prevent bridging and material hang up during unloading. Brackets 654 are at centers away from the slope sheets. All baffles are supported from the top eliminating bottom supports which can cause local bridging during unloading. Space between posts 538 and the car side can also be closed off to prevent product hanging up during unloading. All baffles supported from top of car facilitate complete clean out during unloading.

The purpose of the connection between vertical stiffeners 538 and 610 and vertical arms 542 and 544 is to take out the tendency for the baffle arrangement to move longitudinally in the event of impact. Similarly, tie rods 578 act to hold in place the upper baffle portion. The longitudinal impact forces through the action of beam 538 are taken out in the upper portion in the side plate region and in the lower portion at the side sill region. Transverse rods 536 prevent any tendency for the roof to collapse under the added weight of the three layer baffle and product lading.

Figure 22:
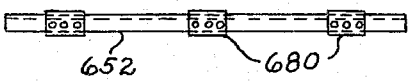
FIG. 22 is a view along the line 22—22 in FIG. 19.

The bottom portion of baffles 546, 548, 566 and 576 are provided with hinge doors indicated 660, 662 and 664 with hinge means 668, 670 and 672. Similarly, baffles 642 and 652 are provided with doors 674 and 676 having appropriate hinge means 678 and 680. An example of appropriate hinge means is shown in FIG. 22. The structure on the right side of the car is preferably construed similar to the left side structure shown and described in detail. Obviously the sides could be reversed.

Considering next the loading sequence, folding chute or conveyer C is moved into the lower portion of the car through the openings formed by the doors in the upper and intermediate baffle system. Thus, the loading chute first places the lading through opening 636*b* and directly to the bottom of the hopper car and loading continues until the lading reaches the approximate lower level of door 660 to define a lading pile 681. Then the door 660 is closed and the chute raised and loading progresses until the bottom of door 674 is reached. At this point the lading pile is shown by line 682. Doors 674 and 662 are closed and loading follows line 684. In forming layer 684 the lower baffle openings are utilized to avoid the lading having to drop long distances. Loading progresses until the bottom of door 676 is reached. The lading pile is shown by line 686. Doors 676 and 664 are closed and loading progresses with the lading pile assuming the line 688 after passing through the intermediate baffle openings **566*b* and 642*b*. Subsequent loading results in the line 690. Further loading results in the use of openings 576*b* and 652*b* and the line 692. The lading then spills over the ends of baffles 574–576 and 652 and loading continues to define the line 694.**

It is thus apparent that through the use of doors in the baffles and openings in the baffles, a chute may be effectively used in loading and large lading drop distances avoided. With three baffles the hoppers may be filled with perishable lading and the lower portion is protected from the weight of the lading above.

Unloading occurs by gravity in a manner similar to the previous embodiments, particularly the arm in FIGS. 14 and 15.

What is claimed is:

1. A transportation hopper comprising:

A. a hopper having a plurality of hopper walls;

B. a loading inlet adapted to load a lading to be transported into said hopper;

C. a lading discharge opening in the lower portion of said hopper;

D. an outlet comprising a closure movable between an open position for discharging the lading, and a closed position wherein the lading is retained in said hopper;

E. at least one layer of baffle means in said hopper vertically spaced above said outlet, said baffle means being generally flat and inclined with respect to the horizontal at an angle sufficient to reduce the contiguous pressure that the lading above the baffle means in the hopper would normally exert on the lading below the baffle means in the absence of said baffle means, and sufficient to allow the lading to flow in and out of the hopper during loading and unloading, and obtain efficient fill of hopper volume during loading:

and support means mounting said baffle means spaced from the walls of said hopper a distance sufficiently large for lading to pass therearound during loading and unloading, and obtain efficient fill of hopper volume during loading, said support means being of sufficient size to transmit to the hopper a sufficient portion of one weight of the lading above the baffle means such that the remainder of the weight of the lading transmitted to the lading below the baffle means through said spaced distance can be supported by the lading below the baffle means without significant damage to the lading below the baffle means;

and at least some of the baffles in said baffle means having at least one lading opening therein of size sufficiently large for lading to pass therethrough during loading and unloading, and to obtain efficient fill of hopper volume during loading; said baffle means being of sufficient size to transmit to the hopper through said baffle means and said support means a sufficient portion of the weight of the lading above the lading openings in the baffle means such that the weight of the lading above the baffle means transmitted through the lading openings in said baffle means to the lading below the baffle means will not cause significant damage to the lading below the baffle means.

2. A transportation hopper according to claim 1 wherein said support means extend from opposite hopper walls.

3. A transportation hopper according to claim 1 wherein said support means comprises at least one flexible member.

4. A transportation hopper according to claim 1 wherein said support means comprises at least one rigid member.

5. A transportation hopper according to claim 1 wherein said baffle means are removably mounted in said hopper.

6. A transportation hopper according to claim 1 wherein said baffle means are permanently mounted in said hopper.

7. a transportation hopper according to claim 1 wherein said support means are affixed to said hopper at a level in the hopper above said baffle means.

8. A transportation hopper according to claim 1 wherein said baffle means define at least one opening therebetween.

9. A transportation hopper according to claim 8 wherein one of said baffle means extends above at least one other of said baffle means.

10. A transportation hopper according to claim 1 wherein means are provided to circulate conditioned air through said hopper.

11. A transportation hopper according to claim 10 wherein said baffle means comprise air circulation openings in addition to said lading openings for allowing conditioned air to pass therethrough.

12. A transportation hopper according to claim 10 wherein said baffle means comprises means for allowing said conditioned air to pass therethrough.

13. A transportation hopper according to claim 12 wherein said baffle means are made of permeable material.

14. A transportation hopper according to claim 10 wherein guide plates are provided in said hopper to direct said conditioned air to the lower portion of the car.

15. A transportation hopper according to claim 1 wherein a second layer of baffle means is provided in said hopper vertically spaced above said one layer of baffle means, said second baffle means being generally flat and inclined with respect to the horizontal at an angle sufficient to reduce the contiguous pressure that the lading above the second baffle means in the hopper would normally exert on the lading below the second baffle means in the absence of said second baffle means, and sufficient to allow the lading to flow in and out of the hopper, and sufficient to obtain efficient fill of hopper volume during loading; and second support means mounting said second baffle means spaced from the walls of said hopper a distance sufficiently large for lading to pass therearound during loading and unloading, and obtain efficient fill of hopper volume during loading, said second support means being of sufficient size to transmit to the hopper a sufficient portion of the weight of the lading above the second baffle means such that the remainder of the weight of the lading transmitted to the lading below the second baffle means through said spaced distance can be supported by the lading below the second baffle means without significant damage to the lading below the second baffle means; and at least some of the baffles in said second baffle means having at least one lading opening therein of size sufficiently large for lading to pass therethrough during loading and unloading, and to obtain efficient fill of hopper volume during loading; and said baffle means being of sufficient size to transmit to the hopper through said second baffle means and said second support means a sufficient portion of the weight of the lading above the second baffle means such that the weight of the lading above the second baffle means transmitted through the lading openings in said second baffle means to the lading below said second baffle means will not cause significant damage to the lading below the second baffle means.

16. A transportation hopper according to claim 15 wherein said first baffle means are supported by support members affixed to said hopper at a lower level than said first baffle means and extend inwardly and upwardly to support the same.

17. A transportation hopper according to claim 16 wherein said support members are joined at about the center portion of the hopper.

18. A transportation hopper according to claim 17 wherein said first baffle means comprise right and left members and wherein the inner end of one of said right and left members is spaced above the other of said right and left members.

19. A transportation hopper according to claim 17 wherein said second means comprise right and left members and wherein the inner end of one of said right and left members is spaced above the other of said right and left members.

20. A transportation hopper according to claim 15 wherein at least a part of the support for said second baffle means comprises a flexible support affixed to said hopper.

21. A transportation hopper according to claim 15 wherein the inner ends of said first and second baffle means are spaced from each other to define a generally central opening in said hopper.

22. A transportation hopper according to claim 15 wherein the inner ends of said first and second baffle means are spaced from each other to define a generally central opening in said hopper.

23. A transportation hopper according to claim 22 wherein said first baffle means comprise right and left members and wherein the inner end of one of said right and left members is spaced above the other of said right and left members.

24. A transportation hopper according to claim 23 wherein said baffle second means comprise right and left members and wherein the inner end of one of said right and left members is spaced above the other of said right and left members.

25. A transportation hopper according to claim 23 wherein said first baffle means comprises right and left members and wherein one of said right and left members comprises a tongue passing through a groove in said other right and left member.

26. A transportation hopper according to claim 25 wherein said second baffle means comprises right and left members and wherein one of said right and left members comprises a tongue passing through a groove in said other right and left member.

27. A transportation hopper according to claim 15 wherein doors are affixed to selected ones of said first and second baffle means.

28. A transportation hopper according to claim 12 wherein a third layer of baffle means is provided in said hopper vertically spaced above said second baffle means; said third baffle means being generally flat and inclined with respect to the horizontal at an angle sufficient to reduce the contiguous pressure that the lading above the third baffle means in the hopper would normally exert on the lading below the third baffle means in the absence of said third baffle means, and sufficient to allow the lading to flow in and out of the hopper, and sufficient to obtain efficient fill of hopper volume during loading; and third support means mounting said third baffle means spaced from the walls of said hopper a distance sufficiently large for lading to pass therearound during loading and unloading, and obtain efficient fill of hopper volume during loading said third support means being of sufficient size to transmit to the hopper a sufficient portion of the weight of the lading above the third baffle means such that the remainder of the weight of the lading transmitted to the lading below the thrid baffle means through said spaced distance can be supported by the lading below the third baffle means without significant damage to the lading below the third baffle means; and at least some of the baffles in said third baffle means having at least one lading opening therein of size sufficiently large for lading to pass therethrough during loading and unloading, and to obtain efficient fill of hopper volume during loading; said third baffle means being of sufficient size to transmit to the hopper through said third baffle means and said third support means a sufficient portion of the weight of the lading above the third baffle mans such that the weight of the lading above the third baffle means transmitted through the lading openings in said third baffle means to the lading below said third baffle means will not cause significant damage to the lading below the third baffle means.

29. A railway hopper car comprising:

A. trucks at opposite ends of the car supporting a plurality of hoppers extending longitudinally in the car;

B. each of said hoppers having a loading inlet adapted to load a lading to be transported into said hopper;

C. a lading discharge opening in the lower portion of said hoppers;

D. an outlet having a closure removable between an open position for discharging the lading, and a closed position wherein the lading is retained in said hoppers;

E. at least one layer of baffle means in said hopper, said baffle means being generally flat and inclined with respect to the horizontal, and adapted to reduce the contiguous pressure that the lading above the baffle means in the hopper would normally exert on the lading below the baffle means in the absence of said baffle means; and support means mounting said baffle means spaced from the walls of said hopper a distance sufficient for lading to pass therearound during loading and unloading, and to obtain efficient fill during loading said support means being of sufficient size to transmit to the hopper a sufficient portion of the weight of the lading above the baffle means such that the remainder of the weight of the lading above the baffle means transmitted to the lading below the baffle means through said spaced distance can be supported by the lading below the baffle means without significant damage to the lading below the baffle means; and at least some of the baffles in said baffle means having at least one lading opening therein of sufficient size for lading to pass therethrough during loading and unloading and obtain efficient fill during loading; said baffle means being of sufficient size to transmit to the hopper through said baffle means being of sufficient size to transmit to the hopper through said baffle means and said support means a sufficient portion of the weight of the lading above the lading openings in said baffle means such that the weight of the lading above the baffle means transmitted through the lading openings in the baffle means to the lading below the baffle means will not cause significant damage to the lading below the baffle means.

30. A railway hopper car according to claim 29 wherein an air conditioning unit is mounted on the car and conditioned air from said air conditioning unit is circulated through said hopper car.

31. A railway hopper car according to claim 30 wherein said baffle means comprise air circulation openings in addition to said lading openings for allowing conditioned air to pass therethrough.

32. A railway hopper car according to claim 30 wherein guide plates are provided to direct said conditioned air into the lower portion of said hoppers.

33. A railway hopper car according to claim 29 wherein a second layer of baffle means is provided in said hopper vertically spaced above said one layer of baffle means; said second baffle means being generally flat and inclined with respect to the horizontal at an angle sufficient to reduce the contiguous pressure that the lading above the second baffle means in the hopper would normally exert on the lading below the second baffle means in the absence of said second baffle means, and suficient to allow the lading to flow in and out of the hopper, and sufficient to obtain efficient fill of hopper volume during loading; and second support means mounting said second baffle means spaced from the walls of said hopper a distance sufficient for lading to pass therearound during loading and unloading, and obtain efficient fill of hopper volume during loading, said second support means being of sufficient size to transmit to the hopper a sufficient portion of the weight of the lading above the second baffle means such that the remainder of the weight of the lading above the second baffle means transmitted to the lading below the second baffle means through said spaced distance can be supported by the lading below the second baffle means without significant damage to the lading below the second baffle means; and at least some of the baffles in said second baffle means having at least one lading opening therein of sufficient size for lading to pass therethrough during loading and unloading, and obtain efficient fill during loading; said second baffle means being of sufficient size to transmit to the hopper through said second baffle means and said second support means a sufficient portion of the weight of the lading above the lading openings in said second baffle means such that the weight of the lading above the second baffle means transmitted through the lading openings in the second baffle means to the lading below the second baffle means will not cause significant damage to the lading below the second baffle means.

34. A railway hopper car according to claim 33 wherein a third layer of baffle means is provided in said hopper vertically spaced above said second layer of baffle means; said third baffle means being generally flat and inclined with respect to the horizontal at an angle sufficient to reduce the contiguous pressure that the lading above the third baffle means in the hopper would normally exert on the lading below the third baffle means in the absence of said third baffle means, and sufficient to allow the lading to flow in and out of the hopper, and sufficient to obtain efficient fill of hopper volume during loading; and third support means mounting said third baffle means spaced from the walls of said hopper a distance sufficient for lading to pass therearound during loading and unloading, and obtain efficient fill of hopper volume during loading, said third support means being of sufficient size transmit to the hopper a sufficient portion of the weight of the lading above the third baffle means such that the remainder of the weight of the lading above the third baffle means transmitted to the lading below the third baffle means through said spaced distance can be supported by the lading below the third baffle means without significant damage to the lading below the third baffle means; and at least some of the baffles in said third baffle means having at least one lading opening therein of sufficient size for lading to pass therethrough during loading and unloading, and obtain efficient fill during loading, said third baffle means being of sufficient size that to transmit to the hopper through said third baffle means and said third support means a sufficient portion of the weight of the lading above the lading openings in said baffle means such that the weight of the lading above the baffle means transmitted through the lading openings in the third baffle means to the lading below the baffle means will not cause significant damage to the lading below the third baffle means.

35. A railway car according to claim 34 wherein doors are affixed to selected ones of said first, second and third baffle means.

36. A railway hopper car according to claim 34 wherein said support means, said second support means, and said third support means each comprise right and left baffle support means affixed to opposite hopper walls, said right and left support means supporting said first, second and third baffle means in their relative positions in said hopper.

37. A railway hopper car according to claim 36 wherein said right and left baffle support means comprise first, second and third baffle support means affixed respectively to said first, second and third baffle means.

38. A railway hopper car according to claim 36 wherein said right and left baffle support means comprise arms extending inwardly from the sides of said hopper.

39. A railway hopper car according to claim 38 wherein said first, second and third support arms extend inwardly and downwardly.

40. A railway hopper car according to claim 39 wherein said third baffle support means further comprise a flexible support affixed to said third baffle means.

41. A railway hopper car according to claim 36 wherein said first, second and third baffle means comprise right and left hand portions and wherein the right hand portion extends to a 36 point lower in the car than the left hand portion.

42. A railway hopper car according to claim 36 wherein said first, second and third baffle means comprise left and right hand portions and wherein the left hand portion extends to a point lower in the car than the right hand portion.

43. A railway hopper car according to claim 38 wherein connecting means connect at least one of said left first, second and third support arms is to at least one of said right first, second and third support arms.

44. A railway hopper car according to claim 43 wherein each of said left support arms are connected to each of said right support arms.

45. A railway hopper can according to claim 36 wherein doors are affixed to selected ones of said first, second and third baffle means.

46. A railway hopper car according to claim 45 wherein said doors are hinged.

47. A railway hopper car according to calim 36 wherein transversely extending spanners are affixed to opposite sides of said hopper.

48. A railway car according to claim 47 wherein vertically extending struts are provided which are affixed to upper and lower portions of opposite sides of the hoppers.

49. A railway hopper car according to claim 38 wherein first baffle support arms for said first baffle means are affixed to the upper portion of the car and wherein said first baffle support arms are bent downwardly and inwardly and first baffle means are affixed to and extend from opposite sides of said first baffle support arms.

50. A railway hopper car according to claim 49 wherein the second baffle support arms are affixed to said first baffle support arms at a point above where the first baffle support arm extends inwardly in the car, and second baffle means are affixed to and extend from opposite sides of said second baffle support arms.

51. A railway hopper car according to claim 50 wherein third baffle means are affixed to and extend from opposite sides of said third baffle support arms.

52. A railway hopper car according to claim 50 wherein transversely extending means are provided which join said first and second baffle support arms.

53. A railway hopper car according to claim 52 wherein at least one of said left hand baffle support arms joins at least one of said right hand baffle support arms.

54. A railway hopper car according to claim 36 wherein at least one of said baffle means include reinforcing ribs.

* * * * *

UNITED STATES PATENT OFFICE

CERTIFICATE OF CORRECTION

PATENT NO. : 3,995,541

DATED : December 7, 1976

INVENTOR(S) : Edward L. Coyle, et. al.

It is certified that error appears in the above-identified patent and that said Letters Patent are hereby corrected as shown below:

Column 1, line 41, "supporting" should read -- baffle --.
Column 1, line 45, "leading" should read -- lading --.
Column 2, line 40, after "joining" insert -- upper --.
Column 4, line 4, "embodiment. This" should read -- embodiment, this --.
Column 4, line 22, "off" should read -- of --.
Column 4, line 38, "or" should read -- of --
Column 4, line 52, "satisfactory" should read -- satisfactorily --.
Column 4, lin3 59, "to" should read -- the --.
Column 5, line 3, "in" should be deleted.
Column 5, line 61, "3,456,241" should read -- 3,486,241 --.
Column 6, line 19, "cara" should read -- car --.
Column 6, line 20, "car" should read -- lading --.
Column 6, line 39, "conveyor" should read -- conveyer --.
Column 6, line 50, "examples" should read -- example --.
Column 7, line 1, "upwardly" (second occurrence) should be deleted.
Column 7, line 1, after "upwardly" (first occurrence) -- through the -- should be inserted.
Column 7, line 19, "permable" should read -- permeable --.
Column 7, line 47, "oif" should read -- of --.
Column 8, line 14, "a" should read -- at --.
Column 8, line 58, after "drop" -- down -- should be inserted.
Column 9, line 28 "define" should read -- defined --.
Column 10, line 5, "In the embodi-" should begin a new paragraph.
Column 11, line 5, after "ropes" -- 746 -- should be inserted.
Column 11, line 15, after "circular" -- cross -- should be inserted
Column 11, line 19, after "with" -- cable -- should be in inserted.
Column 11, line 23, "join " should read -- joins --.
Column 11, line 28, "stroking" should read -- strong --.
Column 11, line 45, "layaer" should read -- layer --.
Column 11, line 60, "laterallly" should read -- laterally --.
Column 13, line 22, "intermediate connection makes" should be deleted.
Column 13, line 23, "the" should be deleted.

UNITED STATES PATENT OFFICE

CERTIFICATE OF CORRECTION

PATENT NO. : 3,995,541

DATED : December 7, 1976

INVENTOR(S) : Edward L. Coyle, et. al.

It is certified that error appears in the above-identified patent and that said Letters Patent are hereby corrected as shown below:

Column 15, line 56, "655" should read -- 566 --.
Column 17, line 55, "one" should read -- the --.
Column 19, line 55, "baffle second" should read -- second baffle--.
Column 22, line 17, after "size" -- to -- should be inserted.
Column 22, line 67, "36" should be deleted.

Column 21, lines 11 and 12, the phrase "being of sufficient size to transmit to the hopper through said baffle means" should be deleted.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*